US009407035B2

(12) United States Patent
Arimai et al.

(10) Patent No.: US 9,407,035 B2
(45) Date of Patent: Aug. 2, 2016

(54) ELECTRONIC DEVICE UNIT

(71) Applicant: Mitsubishi Electric Corporation, Tokyo (JP)

(72) Inventors: Fumiaki Arimai, Tokyo (JP); Shozo Kanzaki, Tokyo (JP); Hiroyoshi Nishizaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/635,191

(22) Filed: Mar. 2, 2015

(65) Prior Publication Data

US 2015/0349461 A1 Dec. 3, 2015

(30) Foreign Application Priority Data

May 28, 2014 (JP) ..... 2014-109753

(51) Int. Cl.

| | |
|---|---|
| ***H01R 12/87*** | (2011.01) |
| ***H01R 13/627*** | (2006.01) |
| ***H01R 13/46*** | (2006.01) |
| ***H01R 13/03*** | (2006.01) |

(Continued)

(52) U.S. Cl.

CPC ..... *H01R 13/6273* (2013.01); *H01R 13/03* (2013.01); *H01R 13/20* (2013.01); *H01R 13/46* (2013.01); *H01R 13/6658* (2013.01); *H01R 31/06* (2013.01); *H01R 43/24* (2013.01); *H01R 13/635* (2013.01); *H01R 2107/00* (2013.01)

(58) Field of Classification Search

CPC ..... H01R 13/6273; H01R 13/03; H01R 13/46
USPC ..... 439/267, 635, 260, 266, 263, 259, 352
See application file for complete search history.

(56) References Cited

U.S. PATENT DOCUMENTS 4,436,792 A * 3/1984 Tomino ..... H01M 6/46 429/1
4,842,538 A * 6/1989 Noschese ..... H01R 12/88 439/260

(Continued)

FOREIGN PATENT DOCUMENTS

JP 3-50783 A 3/1991
JP 3-208276 A 9/1991

(Continued)

OTHER PUBLICATIONS

JPO Office Action for Application No. 2014-109753 dated Feb. 3, 2015.

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

In an electronic device unit, each of the contact terminals includes a first member coupled to a press-fitting and fixing portion through intermediation of an elastically deformable portion, and a second member being coupled to the first member through intermediation of a folding portion and including a pressure bending portion formed at a terminal end of the second member. An end surface covering resin formed on the circuit board presses a pressure bending portion so that a conductive contact portion formed at the folding portion of the first member is pressed against the board-side terminal substantially in a right-angle direction. Thus, sliding contact between the conductive contact portion and the board-side terminal is diminished.

12 Claims, 20 Drawing Sheets

(51) Int. Cl.

| | |
|---|---|
| ***H01R 13/20*** | (2006.01) |
| ***H01R 13/66*** | (2006.01) |
| ***H01R 31/06*** | (2006.01) |
| ***H01R 43/24*** | (2006.01) |
| *H01R 13/635* | (2006.01) |
| *H01R 107/00* | (2006.01) |

(56) References Cited

U.S. PATENT DOCUMENTS 4,904,197 A * 2/1990 Cabourne ..... H01R 12/89 439/260
5,163,835 A * 11/1992 Morlion ..... H01R 13/03 439/108
5,395,260 A * 3/1995 Hayakawa ..... H05K 7/1023 439/266
5,908,323 A * 6/1999 Seidler ..... H01R 13/193 439/266
6,135,798 A * 10/2000 Saruta ..... H01R 24/58 439/259
6,478,596 B2 * 11/2002 Yoshida ..... H05K 7/1007 324/756.01
6,743,033 B2 * 6/2004 Tateishi ..... H05K 7/1023 439/266
6,979,216 B2 * 12/2005 Maeda ..... H01R 12/88 439/260
7,390,208 B1 * 6/2008 Sabo ..... H01R 12/57 439/260
7,527,513 B1 * 5/2009 Okuyama ..... H01R 12/88 439/259
7,572,137 B2 * 8/2009 Fekonja ..... H01R 13/6271 439/259
7,654,845 B2 * 2/2010 Buschle ..... H01R 12/721 439/260
8,523,586 B2 * 9/2013 Eusterholz ..... H01L 31/02013 439/259
8,608,500 B2 * 12/2013 Nowotnick ..... H01R 13/502 439/260
2013/0023160 A1 1/2013 Healey et al.
2015/0349461 A1 * 12/2015 Arimai ..... H01R 13/6273 439/352

FOREIGN PATENT DOCUMENTS

JP 2001-155829 A 6/2001
JP 2012-151005 A 8/2012
JP 2013-118158 A 6/2013
JP 2014-44879 A 3/2014

* cited by examiner

ELECTRONIC DEVICE UNIT

BACKGROUND OF THE INVENTION

1. Field of the Invention

The present invention relates to an electronic device unit including a plurality of board-side terminals formed at an end portion of the circuit board, and being configured to carry out electrical connection to an external device by bringing contact terminals, which are fixed to a connector housing mounted on the circuit board in a removable manner, into contact with the board-side terminals. In particular, the present invention relates to an improvement of an electronic device unit for the purpose of suppressing sliding wear of a conductive contact surface along with insertion and removal of such a card edge connector.

2. Description of the Related Art

In an electronic device unit configured such that board-side terminals each formed of a copper foil pattern formed at an end portion of a circuit board are connected to an external device through intermediation of a card edge connector connected to a wire harness or mounted on a wiring board, various approaches have been made to suppress sliding wear of a conductive contact surface along with insertion and removal of such a card edge connector.

For example, referring to FIG. 1 of a "card edge connector" disclosed in Japanese Patent Application Laid-open No. 2001-155829 (FIG. 1, Abstract, paragraph [0028]), a card-edge type printed board 10 corresponding to the circuit board of the present invention is removably connected, through intermediation of a card edge connector 30, to a connection-target printed board 20 corresponding to an external connection conductor of the present invention. The card edge connector 30 includes a fixed-side connector housing 31 having first contact pins 35, and a pivot-side connector housing 32 having second contact pins 36 and being pivotably supported on pivot portions 33 by engagement portions 34. The first and second contact pins 35 and 36 are brought into contact with the front and back of a pad 11 (board-side terminal of the present invention) formed on the card-edge type printed board 10, and a distal end portion 37 of each second contact pin 36 is brought into sliding contact with a pad 21 formed on the connection-target printed board 20.

The second contact pin 36 has spring property, and hence the pivot-side connector housing 32 in a normal state is separated away from the fixed-side connector housing 31. When the card-edge type printed board 10 is inserted, the card-edge type printed board 10 presses an abutment portion 38 formed at a lower part of the pivot-side connector housing 32, to thereby pivot the pivot-side connector housing 32. In this manner, the pivot-side connector housing 32 and the fixed-side connector housing 31 sandwich the card-edge type printed board 10 therebetween. As a result, it is possible to attain a card edge connector excellent in operability of the insertion and removal of the card-edge type printed board and also excellent in durability without damage to the respective components at the time of the insertion and removal of the card-edge type printed board.

In contrast, referring to FIGS. 1, 4, and 5 of an "electronic device" disclosed in Japanese Patent Application Laid-open No. 2012-151005 (FIG. 1, Abstract, paragraphs [0031] and [0037]), electrodes 12a and 12b are formed on the front and back of an electronic board 10 having an end portion 11 exposed from a case 50. A card edge connector 40 includes a pair of opposing portions 22 and 23 held by a coupling portion 24 so as to be pivotable relative to each other, and biased in a closing direction by a ring-shaped spring portion 25 (see FIG. 3). The pair of opposing portions 22 and 23 includes first terminals 30a and second terminals 30b to which end portions of a harness (not shown) are fixed.

When the card edge connector 40 is inserted to the electronic board 10, the opposing portions 22 and 23 are separated away from each other by a pair of protrusions 27 formed on the opposing portions 22 and 23 (see FIG. 4), and then the pair of protrusions 27 is fitted to a recess 13 formed in the electronic board 10 so that contact portions 31a and 31b of the first and second terminals 30a and 30b are brought into contact with the electrodes 12a and 12b of the electronic board 10.

Thus, the electronic board 10 is inserted under a state in which the contact portions 31a and 31b and the electronic board 10 are out of contact with each other, thereby suppressing such a risk that the electrical connection between the first and second terminals 30a and 30b and the electrodes 12a and 12b fails due to stripping of plating of the contact portions 31a and 31b and adhesion of components of the electronic board 10 onto the contact regions of the contact portions 31a and 31b.

On the other hand, referring to FIGS. 1 and 6 of an "electronic device" disclosed in Japanese Patent Application Laid-open No. 2013-118158 (FIG. 1, Abstract, paragraph [0083]), electrodes 60 are formed on the front and back of a circuit board 12 having an end portion exposed from a case 13. Terminals 30 each connected to one end of a harness 14 are formed in a housing 20 of a card edge connector 11.

A slider 40 to be retreated by pressing from an end surface of the circuit board 12 is provided in an insertion hole 21 of the housing 20. The upper and lower terminals 30 initially compressed by slope surfaces of a trapezoid of the slider 40 are separated away from each other so as to sandwich the circuit board 12 along with the retreat of the slider 40. Then, contact portions 31 of the terminals 30 are brought into contact with the electrodes 60 of the circuit board 12.

Thus, even when the circuit board is repeatedly inserted to and removed from the card edge connector, the reliability of electrical connection can be enhanced as compared to the related art. When the circuit board is inserted to or removed from the card edge connector, there is no such risk that the terminal is damaged or deformed as in the case where a plating layer formed on the surface of the terminal is stripped off due to contact of the contact portion of the terminal with an edge or an electrode forming surface of the circuit board. Further, there is no such risk that short circuit occurs due to, for example, plating chips that are stripped off.

Further, the contact portion 31 is slightly slid along the surface of the electrode 60, thereby being capable of securing a wiping distance for stripping an insulation coating formed on the surface of the electrode 60 and removing foreign matters on the surface.

Further, referring to FIGS. 2 of a first embodiment of a "connector" disclosed in Japanese Utility Model Application Laid-open No. Hei 03-050783 (FIGS. 2 and 3, Scope of Claims for Utility Model Registration), a plurality of connector-side contacts 3 are integrated by a movable mold 4a, and the movable mold 4a is moved at the inside of a connector main body 1a by pressing from an end surface of a printed board 6. As a result, the connector-side contacts 3 are brought into pressure contact with board-side contacts 7 (FIG. 1) by a constriction portion 1c formed in the connector main body 1a.

Further, referring to FIGS. 3 of a second embodiment, the plurality of connector-side contacts 3 are fixed to a connector main body 1b, and a movable mold 4b, which is movable at the inside of the connector main body 1b, is moved at the inside of the connector main body 1b by pressing from the end surface of the printed board 6. As a result, the connector-side contacts 3 are brought into pressure contact with the board-side contacts 7 (FIG. 1) by a constriction portion 4c formed in the movable mold 4b.

In any case, when the printed board 6 is removed, each of the movable molds 4a and 4b is pushed back by a spring 5 so that the connector-side contacts 3 and the board-side contacts 7 are separated from each other.

According to Japanese Patent Application Laid-open No. 2001-155829 (FIG. 1, Abstract, paragraph [0028]), the second contact pin 36 formed on the pivot-side connector housing 32 is connected in series to the pad 11 on the card-edge type printed board 10 side and the pad 21 on the connection-target printed board 20 side. Therefore, there are problems in that the contact reliability is degraded, and that sliding wear of the contact surface occurs due to sliding friction between the pad 21 on the connection-target printed board 20 side and the distal end portion 37 of the second contact pin 36 along with opening and closing operations for the pivot-side connector housing 32.

Further, the contact pressure between the first and second contact pins 35 and 36 and the pad 11 of the card-edge type printed board 10 in a closed state of the pivot-side connector housing 32 is determined based on a pressing force of the card-edge type printed board 10 for pressing the abutment portion 38 formed at the lower part of the pivot-side connector housing 32. This pressing force exhibits a value equal to or less than a value of the contact friction resistance between the first and second contact pins 35 and 36 and the pad 11 of the card-edge type printed board 10. Therefore, there is a problem in that no sufficient pressing force can be obtained.

According to Japanese Patent Application Laid-open No. 2012-151005 (FIG. 1, Abstract, paragraphs [0031] and [0037]), in order to remove the electronic board 10 inserted to the card edge connector 40, it is essential to reduce the inclination of the protrusions 27 fitted to the recess 13 of the electronic board 10. With the reduced inclination, at the time of insertion of the electronic board 10, the amount of insertion movement of the electronic board 10 becomes larger during a period in which the protrusions 27 of the opposing portions 22 and 23 start to be fitted to the recess 13 of the electronic board 10 and then the fitting of the protrusions 27 is completed. Therefore, there is a problem in that, during this period, the amount of sliding friction movement of the contact portions 31a and 31b of the first and second terminals 30a and 30b and the electrodes 12a and 12b of the electronic board 10 becomes larger.

Further, the pair of opposing portions 22 and 23 biased in the closing direction by the ring-shaped spring portion 25 is held by the coupling portion 24 so as to be pivotable relative to each other, and hence a bending force is generated at the end portions of the harness (not shown). Therefore, there is a problem in that the harness is disconnected and the pivoting torque of the coupling portion 24 becomes unstable.

According to Japanese Patent Application Laid-open No. 2013-118158 (FIG. 1, Abstract, paragraph [0083]), during a transition period in which the contact portions 31 of the terminals 30 start to be brought into contact with the electrodes 60 of the circuit board 12 and then the retreat of the slider 40 is completed, the sliding friction occurs between the contact portions 31 and the electrodes 60 so that oxide films formed on the contact surfaces can be removed. However, there is a problem in that the contact surfaces are worn when no oxide film is formed.

Note that, in order to reduce the amount of sliding friction movement, it is only necessary that the gradient of a support surface 41 of the slider 40 be increased. In this case, however, there is a problem in that the slider 40 is difficult to move forward to the initial position when the circuit board 12 is removed.

Further, according to Japanese Utility Model Application Laid-open No. Hei 03-050783 (FIGS. 2 and 3, Scope of Claims for Utility Model Registration), in the first embodiment illustrated in FIGS. 2, the sliding friction does not occur between the connector-side contacts 3 and the board-side contacts 7, but the connector-side contacts 3 need to move at the inside of the connector main body 1a along with insertion and removal of the printed board 6. Therefore, there is a problem in that lead wires 2a are damaged due to bending, and that waterproofing is difficult to carry out.

Note that, in the second embodiment illustrated in FIGS. 3, in the process of pressing the connector-side contacts 3 against the board-side contacts 7 by the constriction portion 4c, the sliding friction occurs between the connector-side contacts 3 and the board-side contacts 7. Therefore, there is a problem in that the sliding wear occurs similarly when the printed board 6 is removed.

SUMMARY OF THE INVENTION

The present invention has been made to solve the problems inherent in the card edge connector including the above-mentioned movable member of the pivoting type or the linearly moving type, and it is therefore an object of the present invention to provide an electronic device unit capable of minimizing the amount of sliding movement of contact surfaces to enhance the durability at the time of insertion and removal of a connector, and also capable of applying a stable contact pressure between the contact surfaces.

According to one embodiment of the present invention, there is provided an electronic device unit, including a connector housing provided to a plurality of board-side terminals formed on at least one of both end surfaces of a circuit board, the connector housing having one end thereof to which an external connection conductor being a wire harness or a wiring board is connected, and including at another end thereof a plurality of contact terminals brought into electrical contact with the board-side terminals, the connector housing being mounted on the circuit board in a removable manner, the contact terminal including:

a press-fitting and fixing portion received and held in a terminal holding portion formed in the connector housing and connected to the external connection conductor in advance or later;

a first member coupled to the press-fitting and fixing portion through intermediation of an elastically deformable portion having a U-shaped structure, a V-shaped structure, or a W-shaped structure;

a second member being coupled to the first member through intermediation of a U-shaped folding portion or a V-shaped folding portion and including a conductive contact portion formed at the coupling portion; and a pressure bending portion bent into an L-shape or a V-shape and coupled to a terminal end portion of the second member through intermediation of a stamped reinforcement portion, the circuit board being received in, fixed to, or molded integrally with an outer resin member being an outer container or a mounting bracket, the plurality of board-side terminals being exposed from the outer resin member, an end surface covering resin being formed at a distal end portion of a board end portion, on which the board-side terminals are formed, and being communicated to the outer resin member, the connector housing being mounted with amounting reference point, which is arranged on the outer resin member, as a reference position, the end surface covering resin being molded integrally with the outer resin member so that a position of an outer side surface of the end surface covering resin is arranged at a predetermined reference dimension from the mounting reference point of the connector housing, the end surface covering resin being configured to push back the pressure bending portion of the contact terminal so that the conductive contact portion is brought into pressure contact with the board-side terminal, after elapse of a predetermined dead travel period, when the connector housing is mounted on the circuit board through intermediation of the outer resin member.

As described above, in the electronic device unit according to one embodiment of the present invention, the plurality of board-side terminals are formed at the end portion of the circuit board, which is exposed from the outer resin member, and the connector housing, which accommodates the contact terminals electrically connected to the board-side terminals, is mounted on the electronic device unit in a removable manner. Each of the contact terminals includes the first member coupled to the press-fitting and fixing portion through intermediation of the elastically deformable portion, and the second member being coupled to the first member through intermediation of the folding portion and including the pressure bending portion formed at the terminal end of the second member. The end surface covering resin formed on the circuit board pushes back the pressure bending portion so that the conductive contact portion formed at the folding portion of the first member is pressed against the board-side terminal.

Thus, in the dead travel period, which is taken until the conductive contact portion reaches a position of contact with the board-side terminal, the conductive contact portion is separated from the board-side terminal so that the board-side terminal is not damaged due to the slide. Even after the end surface covering resin starts to push back the pressure bending portion, the conductive contact portion is pressed against the board-side terminal substantially in a right-angle direction so that the sliding contact between the conductive contact portion and the board-side terminal is diminished. Accordingly, there are attained such effects that the damage to the contact surface due to the slide is suppressed to enhance the contact reliability, and to prevent generation of sliding wear chips and short circuit abnormality or contact failure that may be caused at a peripheral circuit section along with the generation of sliding wear chips.

Further, the contact pressure between the conductive contact portion and the board-side terminal is determined based on the elastic force of the entire contact terminal, and this elastic force is determined based on a pressure movement amount of the pressure bending portion of the contact terminal. This pressure movement amount is determined based on a relative dimensional difference between the position of the end surface of the end surface covering resin formed on the circuit board and the mounting reference point of the connector housing. This relative dimensional difference is not influenced by an error in length dimension of the circuit board, but is uniquely determined based on dimensions of a die for the outer resin member. Accordingly, there is attained such an effect that a stable contact pressure can be obtained.

Note that, the contact terminal has a folding structure of the first member and the second member, and the longitudinal dimension is not added or extended due to such arrangement that the terminal holding portion and the pressure mechanism of the pressure bending portion are mounted in the same region.

DETAILED DESCRIPTION OF THE PREFERRED EMBODIMENTS

First Embodiment

(1) Details of Structure and Action

Figure 1:
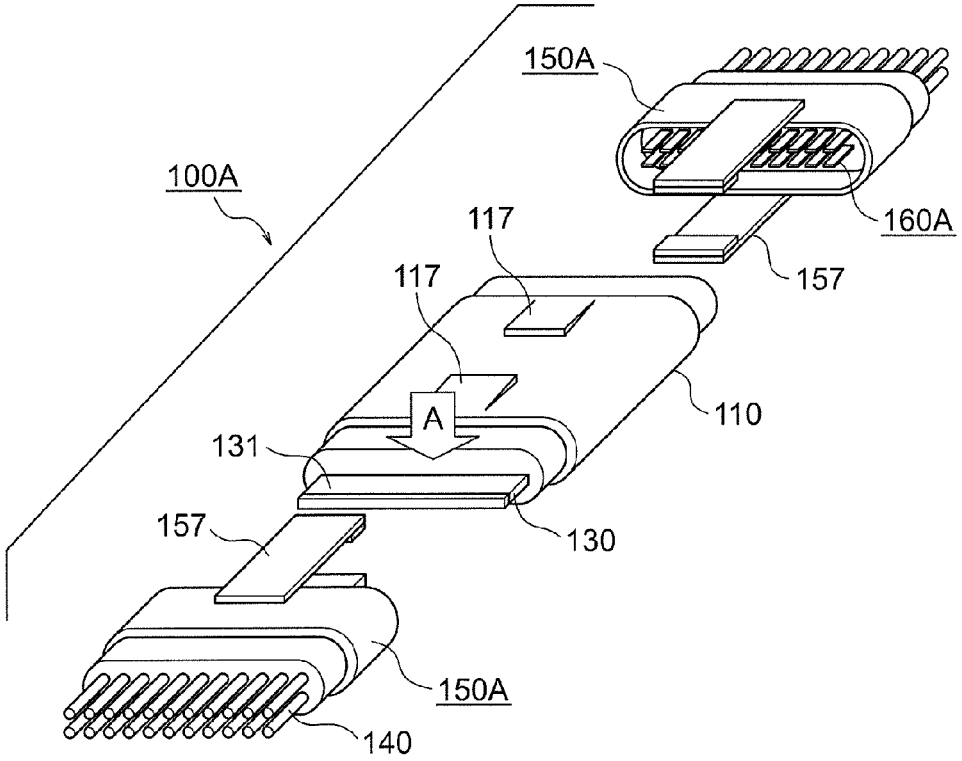
FIG. 1 is a structural view illustrating an entire electronic device unit according to a first embodiment of the present invention.
Figure 2:
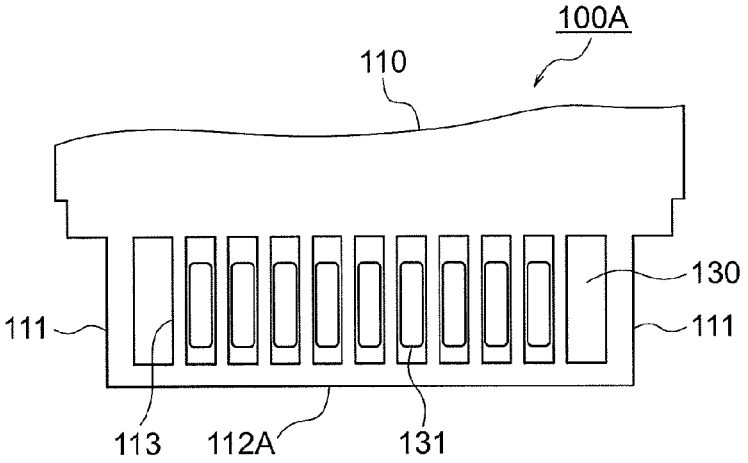
FIG. 2 is a partial detailed view illustrating the electronic device unit of FIG. 1 as seen in a direction indicated by the arrow A.
Figure 3:
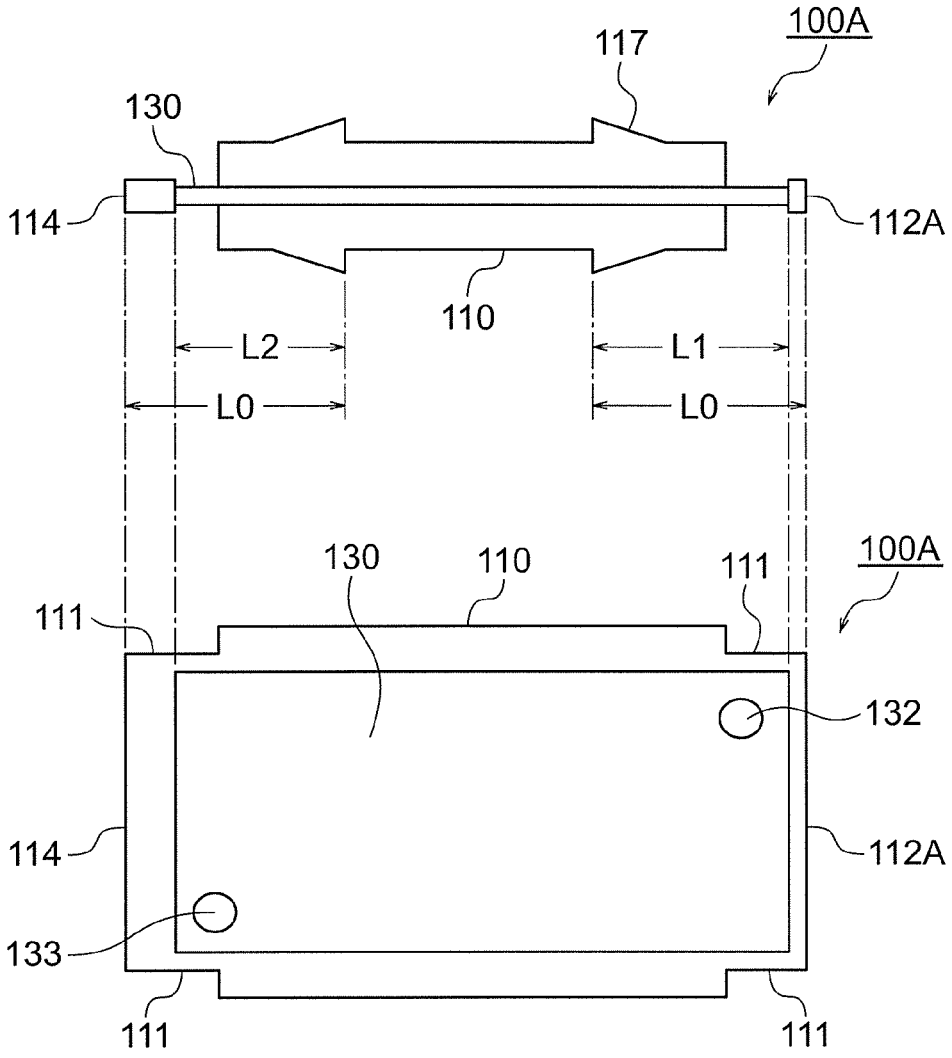
FIG. 3 is an explanatory view illustrating mounting reference points of the electronic device unit of FIG. 1.

First, detailed descriptions are made of FIG. 1, which is a structural view illustrating an entire electronic device unit according to a first embodiment of the present invention, FIG. 2, which is a partial detailed view illustrating the electronic device unit of FIG. 1 as seen in a direction indicated by the arrow A, and FIG. 3, which is an explanatory view illustrating mounting reference points of the electronic device unit of FIG. 1.

In FIG. 1, an electronic device unit 100A mainly includes a circuit board 130 having electronic circuit components (not shown) mounted thereon. The circuit board 130 is molded integrally with an outer resin member 110. In at least one of a front end portion or a rear end portion of the circuit board 130, which is exposed from the outer resin member 110, a plurality of board-side terminals 131 having a copper foil pattern plated with gold are formed on at least one of a front surface or a back surface of the circuit board 130.

A plurality of contact terminals 160A connected to one end of a wire harness 140 in advance are press-fitted and fixed to each connector housing 150A mounted on the electronic device unit 100A in a removable manner. The connector housing 150A is fitted and inserted to the exposed end portion of the circuit board 130, and hence conductive contact portions of the contact terminals 160A are brought into contact with the board-side terminals 131 so that the electronic device unit 100A is electrically connected to an external device (not shown) that is connected to the other end of the wire harness 140.

Note that, elastic hook members 157 are formed on the connector housing 150A made of a resin. The elastic hook members 157 engage with retaining projections 117 formed on the outer resin member 110, and thus the elastic hook members 157 and the retaining projections 117 are integrated with each other.

In FIG. 2, side surface covering resins 111 and 111 and an end surface covering resin 112A are edging portions molded integrally with the outer resin member 110 at positions of both side surfaces and a front end surface of the circuit board 130 in its exposed region.

Further, terminal separating resins 113 are molded integrally at positions between the plurality of contact terminals 131 so as to communicate the end surface covering resin 112A and the outer resin member 110.

FIG. 3 illustrates the circuit board 130 in a sectional side view and a sectional plan view, which are arranged in a vertical direction of the drawing sheet. As illustrated in the part of FIG. 3 corresponding to the sectional side view and the part of FIG. 3 corresponding to the sectional plan view, the end surface covering resin 112A is formed at the front end portion of the circuit board 130, and a rear end covering resin 114 is formed in a case where the connector housing 150A is also provided at a rear end surface of the circuit board 130.

At diagonal positions on the circuit board 130, a pair of reference holes 132 and 133 is formed so as to serve as a reference for accurate determination of component mounting positions on the circuit board 130 and dimensions of the respective portions. When the outer resin member 110 is to be molded integrally, reference projections formed on a die (not shown) are fitted to the reference holes 132 and 133 of the circuit board 130, to thereby carry out the molding.

On the other hand, the accuracy of longitudinal and lateral dimensions of an outer shape of the circuit board 130 is generally low. For example, in a case of a multiple substrate having a plurality of substrates coupled together along score lines and to be bent and cut along the score lines after electronic components have been mounted, the dimensional accuracy of end surface positions cannot be expected, and thus fluctuation may occur in the dimensions measured from the reference holes 132 and 133.

Thus, fluctuation may occur in board position dimensions L1 and L2, which are actual dimensions between an end surface of one retaining projection 117 corresponding to the mounting reference point and a front part of the circuit board 130, and between an end surface of another retaining projection 117 and a rear part of the circuit board 130.

However, a reference dimension L0, which is a distance between the end surface of the retaining projection 117 corresponding to the mounting reference point and a distal end surface of the end surface covering resin 112A (or the rear end covering resin 114), is uniquely determined based on dimensions of the die, and hence a high accuracy dimension is obtained with less fluctuation.

Note that, in the above description, the outer resin member 110 is constructed so as to surround the substantially entire circuit board 130 with the exposed regions secured at both ends thereof. In place of this structure, the following structure may be employed. Specifically, guide rails are formed on inner surfaces of a flat rectangular container made of a metal or a resin, and the circuit board fixed to a bracket is inserted through one opening surface. Then, the opening surface of the flat rectangular container is closed with the bracket, and the connector housing is mounted on the circuit board exposed from the bracket. It is only necessary that the mounting reference point for the connector housing and the end surface covering resin for the circuit board be molded integrally in the bracket.

Further, in place of the wire harness connected to one end of each of the contact terminals 160A, there may be employed a wiring board of such a type that the circuit board is inserted to the connector housing mounted and fixed to the wiring board.

In the following description, however, there is described such a type that the substantially entire circuit board 130 is resin-sealed by the outer resin member 110 and the connector housing 150A is provided to the exposed region at one end of the circuit board 130 so that the circuit board 130 is connected to the external device through the wire harness 140.

Figure 4:
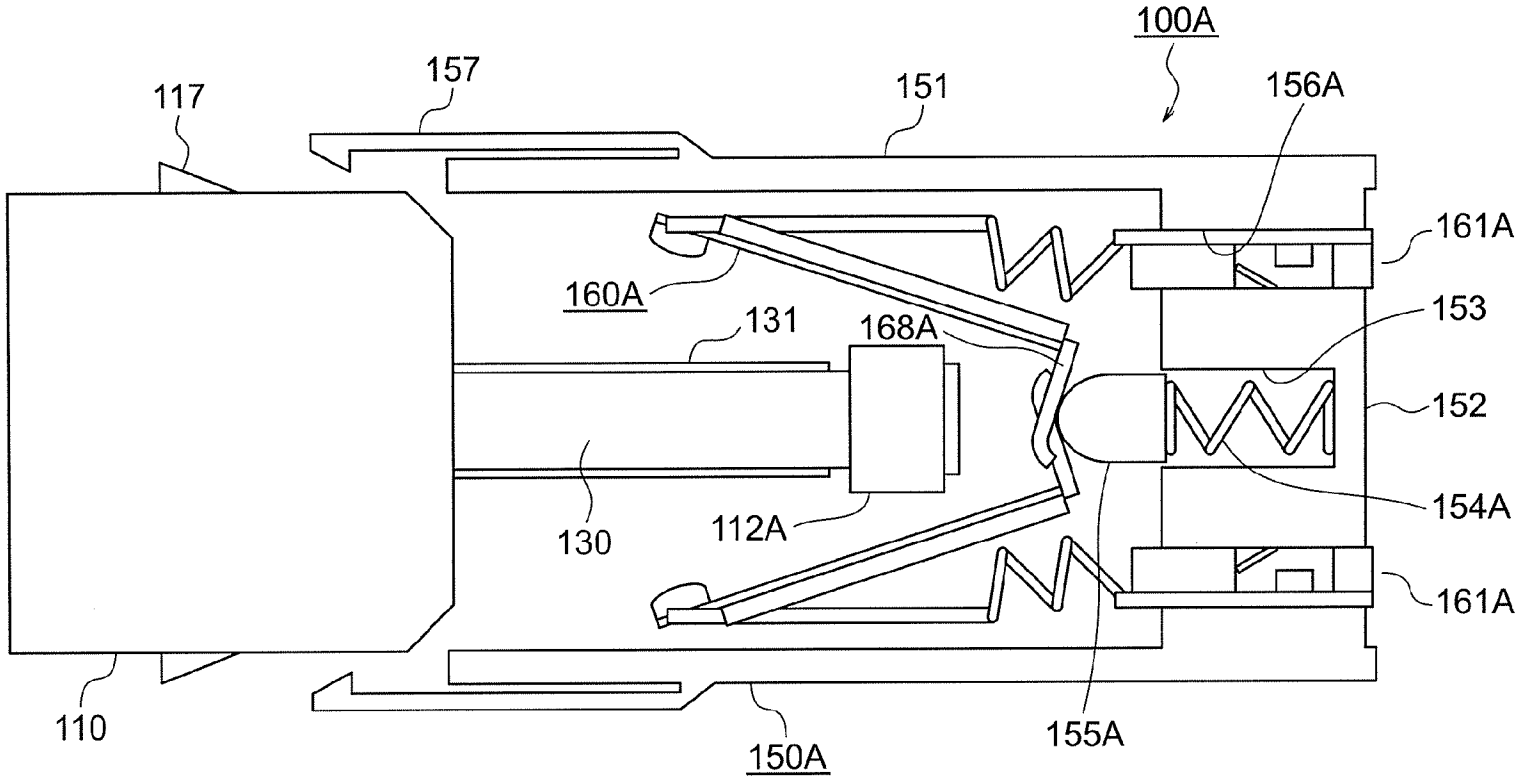
FIG. 4 is a sectional view illustrating a state at the start of insertion of a connector housing of the electronic device unit of FIG. 1.
Figure 5:
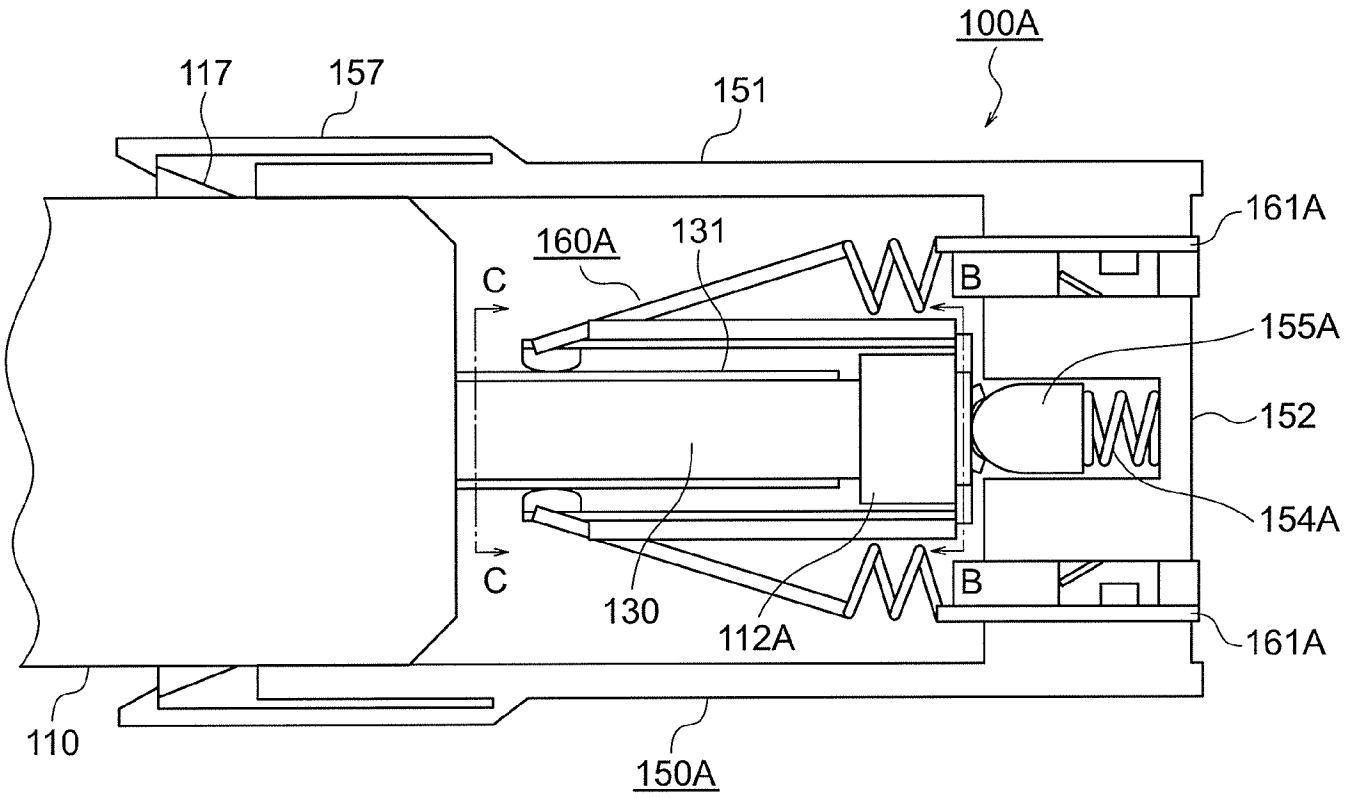
FIG. 5 is a sectional view illustrating a state at the completion of insertion of the connector housing of the electronic device unit of FIG. 1.
Figure 6A:
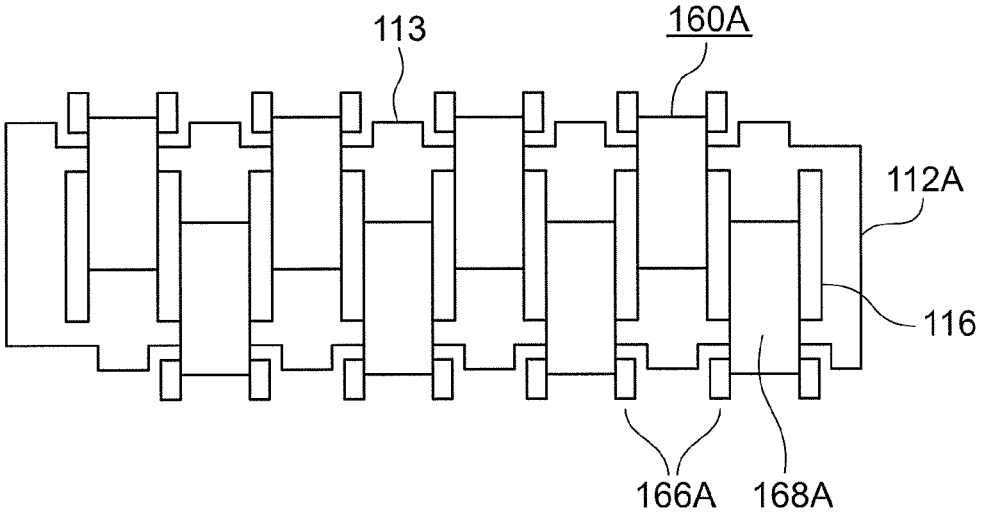
FIG. 6A is a partial detailed view illustrating the electronic device unit of FIG. 5 as seen in a direction indicated by the arrow B-B.
Figure 6B:
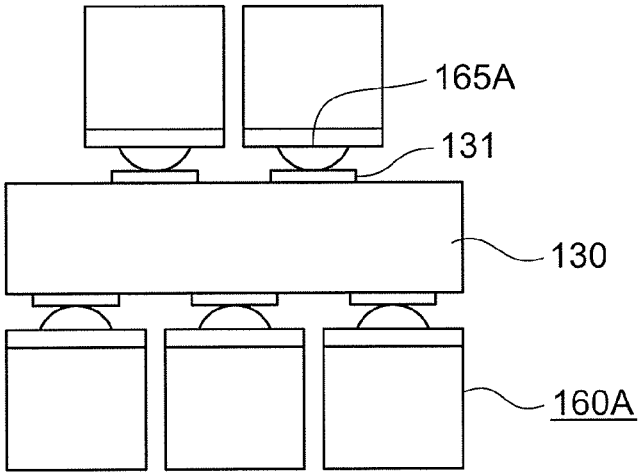
FIG. 6B is a partial detailed view illustrating the electronic device unit of FIG. 5 as seen in a direction indicated by the arrow C-C.
Figure 7A:
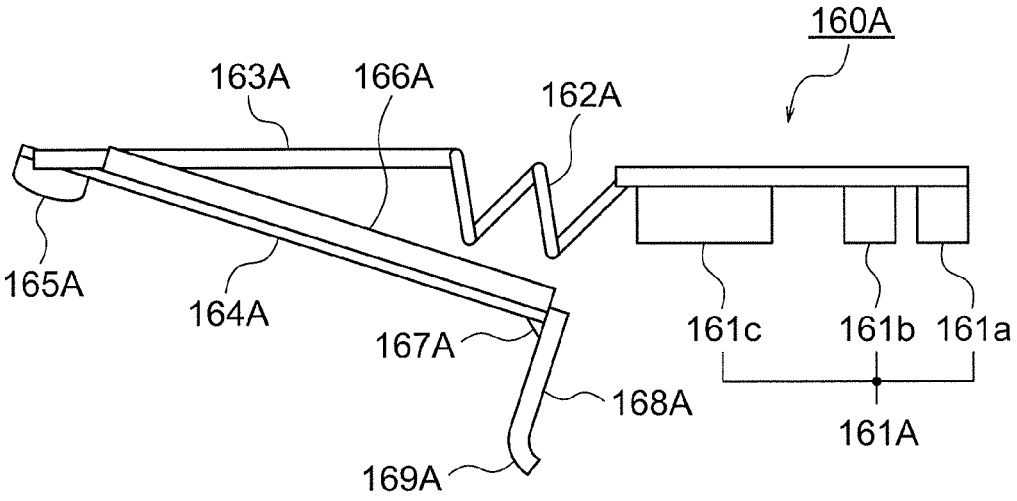
FIG. 7A is a side view illustrating a contact terminal of the electronic device unit of FIG. 1.
Figure 7B:
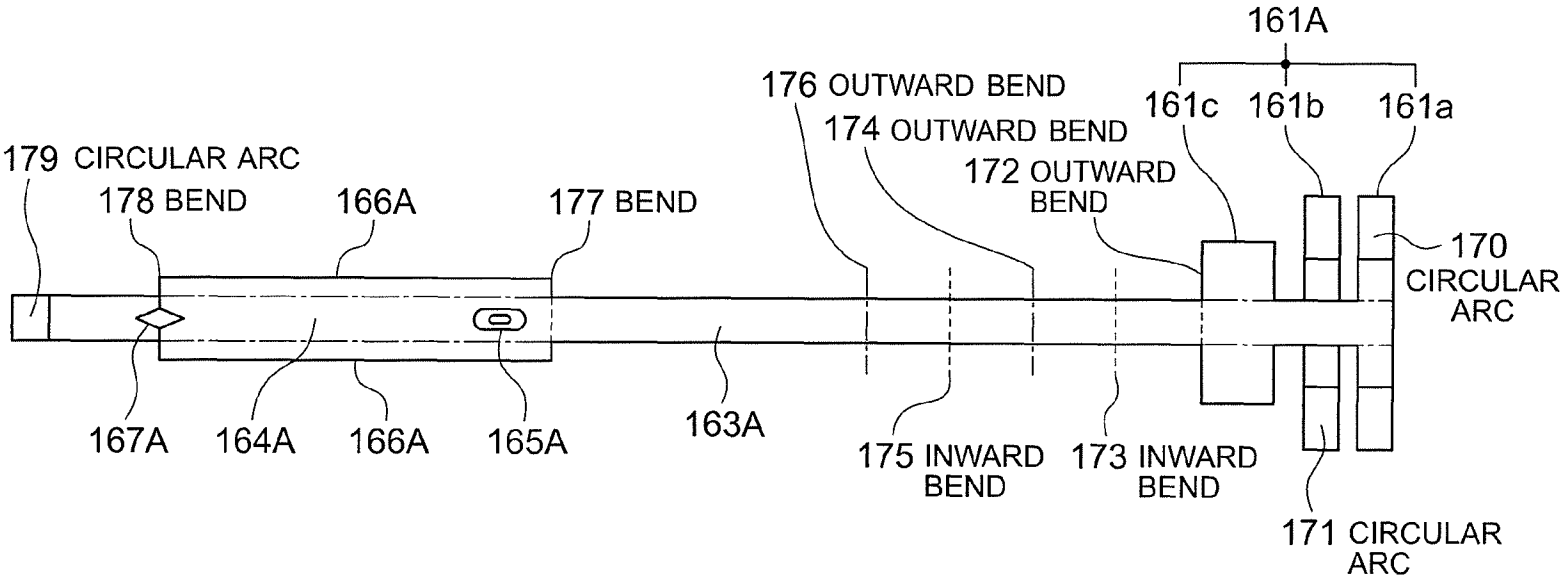
FIG. 7B is a developed view illustrating the contact terminal of the electronic device unit of FIG. 1.

Next, detailed descriptions are made of FIG. 4, which is a sectional view illustrating a state at the start of insertion of the connector housing of the electronic device unit of FIG. 1, FIG. 5, which is a sectional view illustrating a state at the completion of insertion of the connector housing, FIGS. 6A and 6B, which are partial detailed views illustrating the electronic device unit of FIG. 5 as seen in directions indicated by the arrows B-B and C-C, and FIGS. 7A and 7B, which are a side view and a developed view illustrating the contact terminal of the electronic device unit of FIG. 1.

FIG. 4 illustrates a state in which a distal end locking portion of each elastic hook member 157 of the connector housing 150A is positioned sufficiently away from the retaining projection 117 of the outer resin member 110 and the connector housing 150A starts to be inserted to the board-side terminals 131 of the circuit board 130.

The connector housing 150A includes a tubular peripheral wall member 151 and a bottom wall member 152. The tubular peripheral wall member 151 includes the elastic hook members 157, and the bottom wall member 152 includes terminal holding portions 156A to which the contact terminals 160A are press-fitted and fixed, and a center recess portion 153 to which a pressure member 155A and a pressure spring 154A described later are inserted.

Note that, the pressure member 155A is a columnar resin molded product having a bullet shape in its cross section and extending from front to back of the drawing sheet of FIG. 4. The pressure spring 154A is desirably divided into two springs so as to press the columnar pressure member 155A evenly in a leftward direction of FIG. 4. Accordingly, the pressure member 155A is laterally slidable along inner walls of the center recess portion 153.

Further, in this embodiment, the pressure spring 154A and the pressure member 155A are inserted to the connector housing 150A, and then the contact terminals 160A are inserted from left to right of FIG. 4 so that the connector housing 150A is assembled. After that, the wire harness having cap-shaped terminals at one end thereof is press-fitted to wire holding portions 161*a* and 161*b* of the contact terminals 160A (see FIGS. 7A and 7B).

As illustrated in FIG. 7A, each contact terminal 160A includes a press-fitting and fixing portion 161A received and held in the terminal holding portion 156A of the connector housing 150A and to be connected to the external connection conductor 140 later, a first member 163A coupled to the press-fitting and fixing portion 161A through intermediation of an elastically deformable portion 162A having a W-shaped structure, a second member 164A being coupled to the first member 163A through intermediation of a V-shaped folding portion and including a conductive contact portion 165A formed at the coupling portion, and a pressure bending portion 168A bent into an L-shape and coupled to a terminal end portion of the second member 164A through intermediation of a stamped reinforcement portion 167A. Further, the pressure bending portion 168A has a circular-arc pressure contact surface 169A at a distal end thereof.

Note that, the contact terminal 160A is a copper alloy, as typified by brass excellent in conductivity and spring property, caoted by an oxidation-resistant material after a bending process, the oxidation-resistant material is gold or the oxidation-resistant material is gold as a main component. A reinforcement rib 166A is formed on side surfaces of the second member 164A, and the conductive contact portion 165A has a stamped circular-arc surface formed at the folding and coupling portion between the first member 163A and the second member 164A. The elastic strength of the contact terminal 160A is adjusted based on a length of the reinforcement rib 166A and a bending height of the rib.

In FIG. 5, which is a sectional view illustrating a state at the completion of insertion of the connector housing 150A, the pressure contact surface 169A (see FIGS. 7A and 7B) positioned at the distal end of the contact terminal 160A abuts against an outer surface of the end surface covering resin 112A of the circuit board 130, and an intermediate portion of the pressure bending portion 168A (see FIGS. 7A and 7B) is pressed by a distal end surface of the bullet shape of the pressure member 155A with the abutment surface as a fulcrum. As a result, the second member 164A (see FIGS. 7A and 7B) is pivoted counterclockwise up to a position parallel to a board surface of the circuit board 130. Accordingly, the conductive contact portion 165A is brought into electrical contact with the board-side terminal 131.

At this time, the pressing force of the pressure member 155A is applied to the plurality of contact terminals 160A in a distributed manner, but the contact pressure between each conductive contact portion 165A and the board-side terminal 131 fluctuates depending on, for example, fluctuation in bending angle of the pressure bending portion 168A. In order to reduce the fluctuation amount, the second member 164A and the pressure bending portion 168A are adjusted so as to have appropriate elasticity.

Further, in the state of FIG. 5, the elastically deformable portion 162A (see FIGS. 7A and 7B) of the contact terminal 160A acts in a direction of diminishing the contact pressure between the conductive contact portion 165A and the board-side terminal 131. However, the elastically deformable portion 162A is configured to return the contact terminal 160A to a released state of FIG. 4, and has no torque loss that may be caused by a pivoting mechanism. Therefore, it is only necessary that the elastically deformable portion 162A be lightweight to such a degree that the elastically deformable portion 162A may withstand the weight of the contact terminal 160A.

Thus, the pressing force of the pressure spring 154A is converted orthogonally by the pressure bending portion 168A, and is utilized efficiently and effectively as the contact pressure applied at the conductive contact portion 165A. Further, a force component for causing a slide in a plane direction is not even generated between the conductive contact portion 165A and the board-side terminal 131.

In FIG. 6A, which is a partial detailed view illustrating the electronic device unit of FIG. 5 as seen in a direction indicated by the arrow B-B, partition walls 116 are formed on the end surface covering resin 112A that is formed on the end surface of the circuit board 130. The pressure bending portion 168A of each contact terminal 160A is interposed between the partition walls 116.

In FIG. 6B, which is a partial detailed view illustrating the electronic device unit of FIG. 5 as seen in a direction indicated by the arrow C-C, the board-side terminals 131 formed on the front and back of the circuit board 130 are arranged alternately in a staggered manner. Along with this arrangement, the contact terminals 160A are also arranged alternately on the front and back of the circuit board 130, thereby being capable of securing a length dimension of the pressure bending portion 168A.

In FIG. 7A, which is a side view illustrating the contact terminal 160A, the above-mentioned press-fitting and fixing portion 161A includes the wire holding portions 161*a* and 161*b* to which the cap-shaped terminals of the wire harness 140 are press-fitted, and a terminal holding portion 161*c* for fixing the entire contact terminal 160A to the terminal holding portion 156A of the connector housing 150A.

In FIG. 7B, which is a developed view illustrating the contact terminal 160A, clipping circular-arc portions 170 and 171 correspond to circular-arc portions to which the cap-shaped terminals of the wire harness 140 are press-fitted. A first outward bending line 172 corresponds to a bending portion positioned at the coupling portion between the elastically deformable portion 162A and the press-fitting and fixing portion 161. A first inward bending line 173 corresponds to a bending portion of a W-shape valley part of the elastically deformable portion 162A having the W-shape. A second outward bending line 174 corresponds to a bending portion of a W-shape peak part of the elastically deformable portion 162A having the W-shape. A second inward bending line 175 corresponds to a bending portion of another W-shape valley part of the elastically deformable portion 162A having the W-shape. A third outward bending line 176 corresponds to a bending portion positioned at the coupling portion between the elastically deformable portion 162A and the first member 163A. A first bending line 177 corresponds to a bending portion positioned at the coupling portion between the first member 163A and the second member 164A. A second bending line 178 corresponds to a bending portion positioned at the coupling portion between the second member 164A and the pressure bending portion 168A. An abutment circular-arc portion 179 corresponds to a circular-arc portion formed on the pressure contact surface 169A.

In the above description, the elastically deformable portion 162A has the W-shape. In place of the W-shape, the elastically deformable portion may have a V-shape or a U-shape.

Similarly, the folding and coupling portion between the first member 163A and the second member 164A may have a U-shape in place of the V-shape.

Further, in place of the pressure spring 154A formed of a coil spring, pressure springs of a leaf spring type, which are provided to the individual contact terminals 160A, may be press-fitted and fixed to the bottom wall member 152 side of the connector housing 150A.

In this case, the second member 164A and the pressure bending portion 168A do not need to have elasticity, and the reinforcement rib 166A may be extended over the entire region of the second member 164A and the pressure bending portion 168A, to thereby provide a rigid body.

Further, the pressure spring 154A and the pressure member 155A of FIG. 4 may be held by a columnar projection portion 158 described later with reference to FIG. 8 instead of being held by the center recess portion 153.

(2) Summary and Feature of First Embodiment

As is apparent from the above description, the electronic device unit 100A according to the first embodiment of the present invention includes the connector housing 150A provided to the plurality of board-side terminals 131 formed on at least one of both end surfaces of the circuit board 130. The connector housing 150A has connected at one end thereof the external connection conductor 140 being the wire harness or the wiring board, and includes at another end thereof the plurality of contact terminals 160A brought into electrical contact with the board-side terminals 131. The connector housing 150A is mounted on the circuit board 130 in a removable manner.

The contact terminal 160A includes: the press-fitting and fixing portion 161A received and held in the terminal holding portion 156A formed in the connector housing 150A and connected to the external connection conductor 140 later; the first member 163A coupled to the press-fitting and fixing portion 161A through intermediation of the elastically deformable portion 162A having the W-shaped structure; the second member 164A being coupled to the first member 163A through intermediation of the V-shaped folding portion and including the conductive contact portion 165A formed at the coupling portion; and the pressure bending portion 168A bent into the L-shape and coupled to the terminal end portion of the second member 164A through intermediation of the stamped reinforcement portion 167A.

Further, the circuit board 130 is molded integrally with the outer resin member 110 being an outer container. The board-side terminals 131 are exposed from the outer resin member 110. The circuit board 130 includes the end surface covering resin 112A formed at the distal end portion of the board end portion, on which the board-side terminals 131 are formed, and communicated to the outer resin member 110.

The connector housing 150A is mounted with the mounting reference point, which is arranged on the outer resin member 110, as the reference position.

The end surface covering resin 112A is molded integrally with the outer resin member 110 so that the position of the outer side surface of the end surface covering resin 112A is arranged at the predetermined reference dimension L0 from the mounting reference point of the connector housing 150A.

The end surface covering resin 112A is configured to push back, when the connector housing 150A is mounted on the circuit board 130 through intermediation of the outer resin member 110, after elapse of the predetermined dead travel period, the pressure bending portion 168A of the contact terminal 160A so that the conductive contact portion 165A is brought into pressure contact with the board-side terminal 131.

As described above, in the electronic device unit 100A according to the present invention, the plurality of board-side terminals 131 are formed at the end portion of the circuit board 130, which is exposed from the outer resin member 110, and the connector housing 150A, which accommodates the contact terminals 160A electrically connected to the board-side terminals 131, is mounted on the electronic device unit 100A in a removable manner. Each of the contact terminals 160A includes the first member 163A coupled to the press-fitting and fixing portion 161A through intermediation of the elastically deformable portion 162A, and the second member 164A being coupled to the first member 163A through intermediation of the folding portion and including the pressure bending portion 168A formed at the terminal end of the second member 164A. The end surface covering resin 112A formed on the circuit board 130 pushes back the pressure bending portion 168A so that the conductive contact portion 165A formed at the folding portion of the first member 163A is pressed against the board-side terminal 131.

In particular, according to the first embodiment, under a state in which the conductive contact portion 165A is brought into contact with the board-side terminal 131, the second member 164A of the contact terminal 160A is parallel to the board surface of the circuit board 130, and the conductive contact portion 165A is brought into pressure contact with the board-side terminal 131 in a right-angle direction. Accordingly, there is a remarkable feature in that no sliding friction occurs between the conductive contact portion 165A and the board-side terminal 131. Unless the board-side terminals 131 formed on the front and back of the circuit board 130 are arranged alternately in a staggered manner, however, the pressure bending portions 168A cannot be arranged in line along the end surface of the circuit board 130.

The connector housing 150A includes the tubular peripheral wall member 151 and the bottom wall member 152.

The tubular peripheral wall member 151 includes the elastic hook member 157 engageable with the retaining projection 117 corresponding to the mounting reference point on the outer resin member 110.

The bottom wall member 152 has a through-hole through which a connection lead terminal to be connected to the external connection conductor 140 being the wire harness is drawn out, or a through-hole through which a connection lead terminal to be connected to the external connection conductor 140 being the wiring board is drawn out.

The bottom wall member 152 further has the terminal holding portion 156A to which the press-fitting and fixing portion 161A of the contact terminal 160A is press-fitted and fixed, and the center recess portion 153 or the columnar projection portion 158 in which the pressure member 155A biased by the pressure spring 154A in a push-out relationship is received.

The circular-arc pressure contact surface 169A to be pushed back by the end surface covering resin 112A is formed at the distal end position of the pressure bending portion 168A, which is bent into the L-shape at a substantially right angle from the second member 164A of the contact terminal 160A.

The circular-arc end surface of the pressure member 155A abuts against a pressure surface between the pressure contact surface 169A and the stamped reinforcement portion 167A of the contact terminal 160A.

When the connector housing 150A is mounted on the circuit board 130 through intermediation of the outer resin member 110, after elapse of the predetermined dead travel period, the end surface covering resin 112A pushes back the pressure contact surface 169A of the contact terminal 160A to pivot the second member 164A with the circular-arc end surface of the pressure member 155A as a fulcrum so that the conductive contact portion 165A is brought into pressure contact with the board-side terminal 131.

As described above, according to claim 2 of the present invention, the pressure bending portion of the contact terminal is pressed by the connector housing through intermediation of the pressure spring and the circular-arc end surface of the pressure member, and the pressure contact surface is pushed back by the end surface covering resin on the circuit board side so that the conductive contact portion is brought into pressure contact with the board-side terminal.

Thus, the conductive contact portion is brought into pressure contact with the board-side terminal in the right-angle direction so that no slide or slip occurs. Accordingly, there is a feature in that a predetermined pressure regulated by the pressure spring is obtained as the pressure for the pressure contact.

The elastically deformable portion 162A holds the entire contact terminal 160A at a released initial position, to thereby avoid contact between the conductive contact portion 165A and the board-side terminal 131 within the predetermined dead travel period of the connector housing 150A, which is taken until the pressure bending portion 168A is pushed back by the end surface covering resin 112A.

Under a state in which the conductive contact portion 165A and the board-side terminal 131 are brought into pressure contact with each other by the pressure spring 154A, a relationship among a contact pressure P0 to be diminished by the elastically deformable portion 162A, a contact pressure P1 to be applied by the pressure spring 154A, and an effective contact pressure P1−P0 is P1−P0>P0.

As described above, according to claim 4 of the present invention, the contact terminal does not have a sliding rotational shaft, and is fixed through intermediation of the elastically deformable portion. Therefore, the contact pressure between the conductive contact portion and the board-side terminal, which is diminished by the elastically deformable portion, can exhibit a sufficiently smaller value than the contact pressure generated by the pressure spring.

Thus, the contact terminal is separated away and retreated in a natural state, and the contact terminal can easily be inserted beyond the end surface covering resin at the time of mounting the connector housing. Accordingly, there is a feature in that the pressing force of the pressure spring is utilized effectively so that the conductive contact portion can be brought into pressure contact with the board-side terminal.

The same applies to a second embodiment of the present invention described later.

The end surface covering resin 112A is communicated to the outer resin member 110 by at least one of the side surface covering resin 111 formed at a side surface end portion of the circuit board 130 and the plurality of terminal separating resins 113 formed between the plurality of board-side terminals 131.

As described above, according to claim 8 of the present invention, the end surface covering resin is communicated to the outer resin member by at least one of the side surface covering resins and the terminal separating resins.

Accordingly, there is a feature in that the end surface covering resin can be molded integrally with the outer resin member without being peeled off.

Further, when the terminal separating resins are formed, there is a feature in that the positions of the contact terminals can be stabilized.

The same applies to the second to fourth embodiments of the present invention described later.

The board-side terminal 131 is formed by coating a surface of a copper foil pattern coated by an oxidation-resistant material, the oxidation-resistant material is gold or the oxidation-resistant material is gold as a main component.

The contact terminal 160A is a copper alloy, as typified by brass excellent in conductivity and spring property, caoted by an oxidation-resistant material after a bending process, the oxidation-resistant material is gold or the oxidation-resistant material is gold as a main component.

As described above, according to claim 9 of the present invention, the board-side terminal and the contact terminal are each subjected to surface treatment with the oxidation-resistant material.

Thus, no sliding friction occurs between the conductive contact portion and the board-side terminal along with the mounting of the connector housing. As a result, even without a wiping effect of removing an oxide film, generation of the oxide film is prevented in the first place. Accordingly, there is a feature in that the sliding friction is minimized so as to prevent damage to the contact surface, thereby being capable of enhancing and maintaining the contact reliability.

The same applies to the second to fourth embodiments of the present invention described later.

The contact terminal 160A further includes the reinforcement rib 166A formed by bending the side surface of the contact terminal 160A or the reinforcement rib 166A formed by stamping the center of the contact terminal 160A into a circular-arc shape.

The conductive contact portion 165A has the stamped circular-arc surface formed at the folding and coupling portion between the first member 163A and the second member 164A.

The elastic strength of the contact terminal 160A is adjusted based on the length of the reinforcement rib 166A at the part positioned in the second member 164A and the bending height of the rib or the stamping depth of the rib.

As described above, according to claim 10 of the present invention, the elastic strength of the contact terminal is determined based on the reinforcement rib formed on the second member of the contact terminal.

Accordingly, there is a feature in that, even with use of the contact terminal being a thin plate member, when the pressure bending portion is pressed or pushed back, a necessary contact pressing force can be applied between the conductive contact portion and the board-side terminal.

Further, the conductive contact portion is processed into the circular-arc shape. Accordingly, there is a feature in that damage to the board-side terminal due to the contact can be prevented.

The same applies to the second to fourth embodiments of the present invention described later.

Second Embodiment (1) Details of Structure and Action

Figure 8:
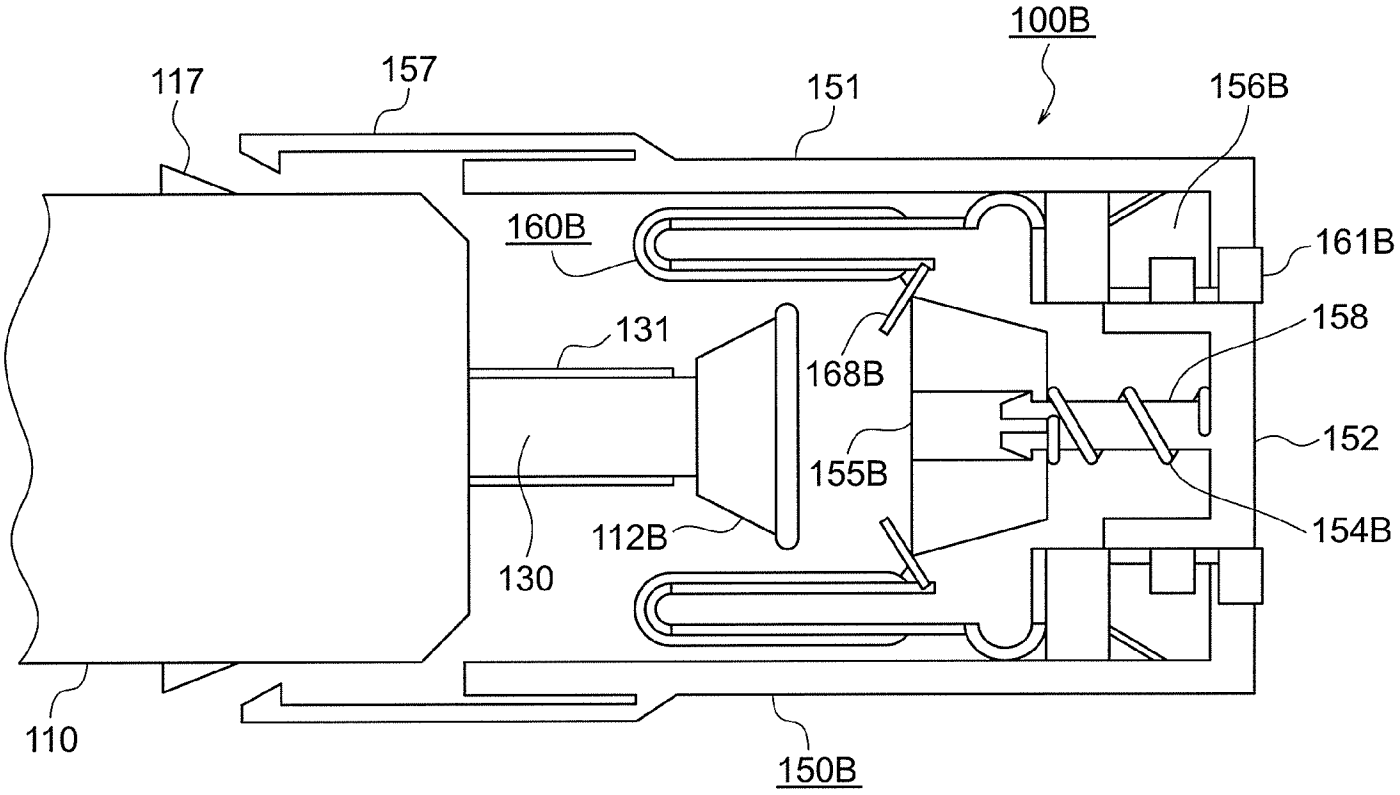
FIG. 8 is a sectional view illustrating a state at the start of insertion of a connector housing of an electronic device unit according to a second embodiment of the present invention.
Figure 9:
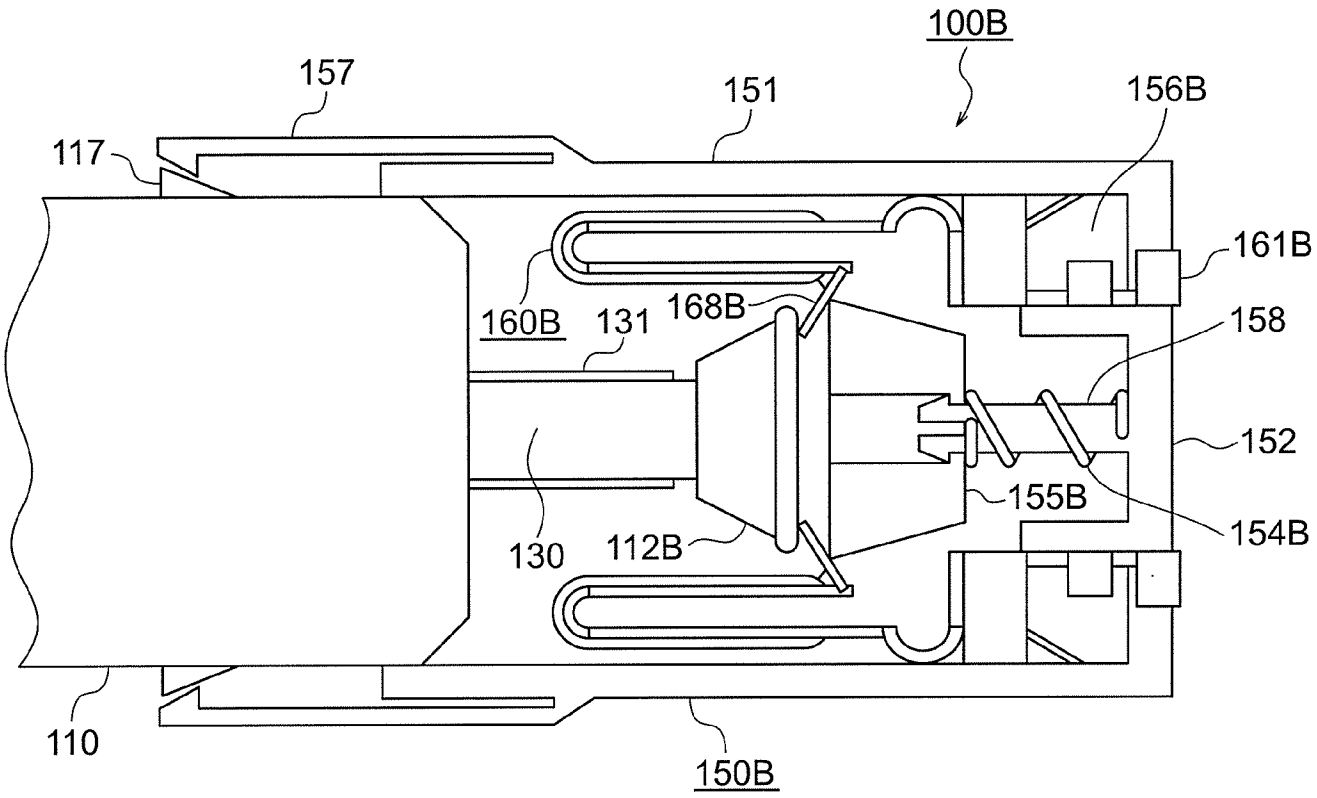
FIG. 9 is a sectional view illustrating a state in the middle of insertion of the connector housing of the electronic device unit of FIG. 8.
Figure 10:
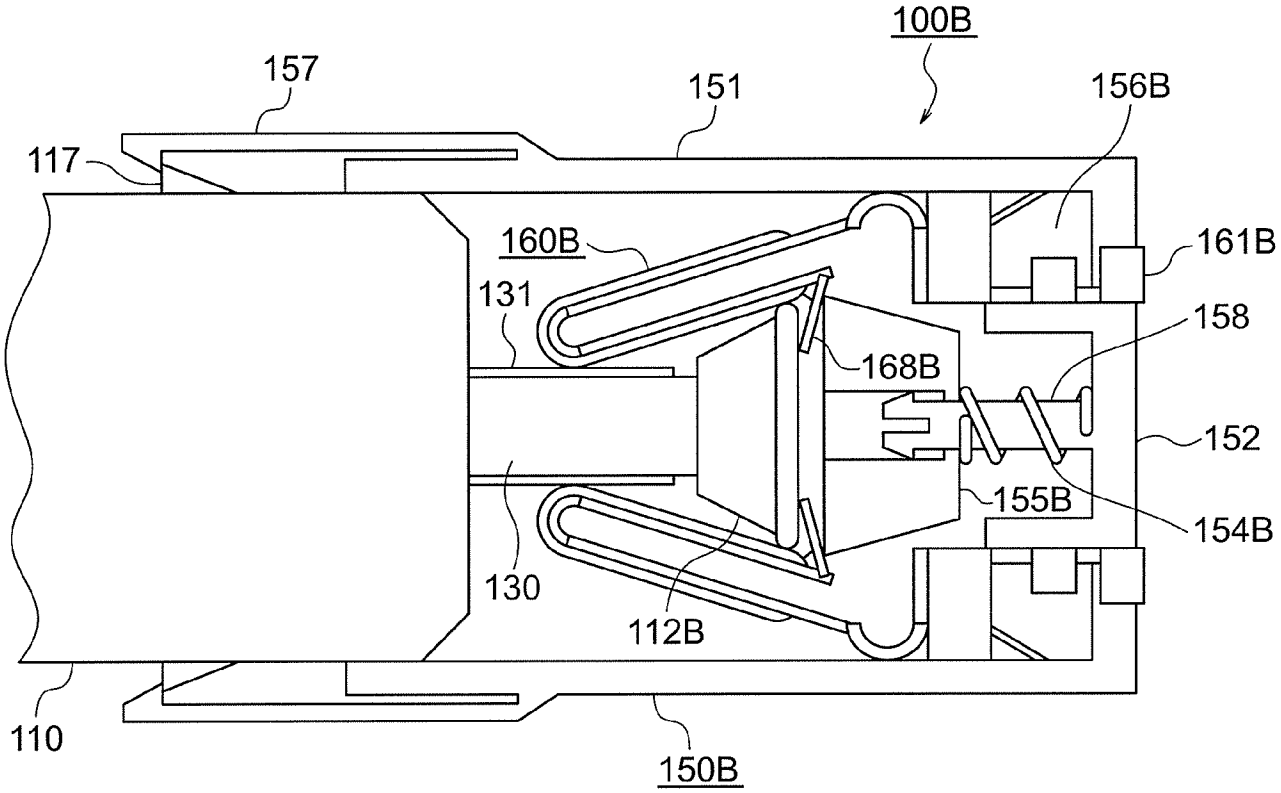
FIG. 10 is a sectional view illustrating a state at the completion of insertion of the connector housing of the electronic device unit of FIG. 8.
Figure 11A:
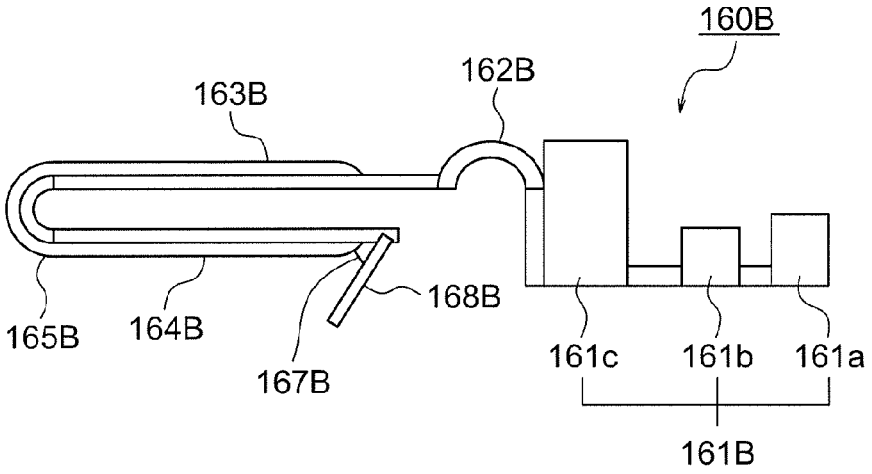
FIG. 11A is a side view illustrating a contact terminal of the electronic device unit of FIG. 8.
Figure 11B:
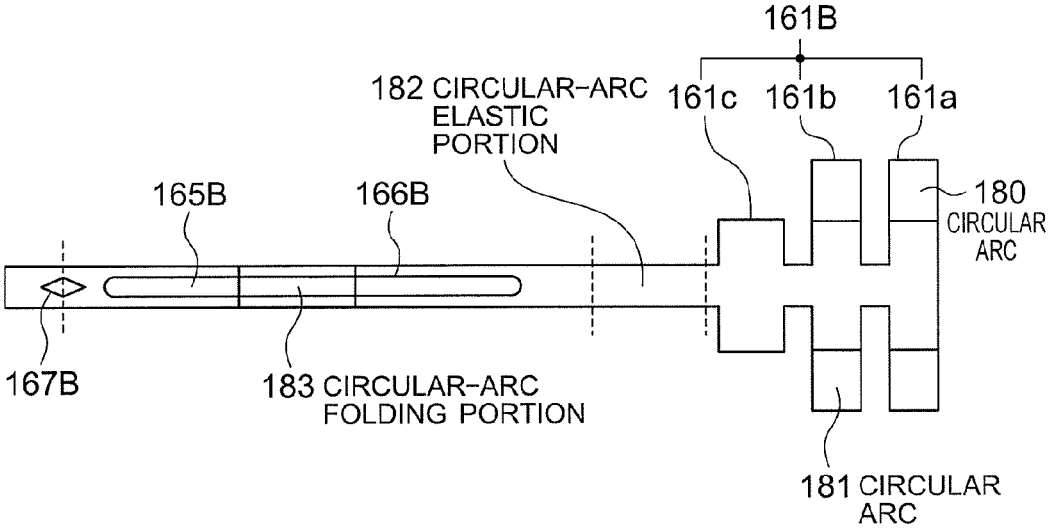
FIG. 11B is a developed view illustrating the contact terminal of the electronic device unit of FIG. 8.

Now, focusing on differences from FIGS. 1 to 7B, detailed descriptions are made of FIG. 8, which is a sectional view illustrating a state at the start of insertion of a connector housing of an electronic device unit according to a second embodiment of the present invention, FIG. 9, which is a sectional view illustrating a state in the middle of insertion of the connector housing, FIG. 10, which is a sectional view illustrating a state at the completion of insertion of the connector housing, and FIGS. 11A and 11B, which are a side view and a developed view illustrating a contact terminal of FIG. 8.

Note that, in the figures, the same reference symbols represent the same or corresponding parts.

FIG. 8 illustrates a state in which a distal end locking portion of each elastic hook member 157 of a connector housing 150B is positioned sufficiently away from the retaining projection 117 of the outer resin member 110 and the connector housing 150B starts to be inserted to the board-side terminals 131 of the circuit board 130.

The connector housing 150B includes the tubular peripheral wall member 151 and the bottom wall member 152. The tubular peripheral wall member 151 includes the elastic hook members 157, and the bottom wall member 152 includes terminal holding portions 156B to which contact terminals 160B are press-fitted and fixed, and the columnar projection portion 158 to which a pressure member 155B and a pressure spring 154B described later are inserted.

Note that, the pressure member 155B is a columnar resin molded product having a trapezoidal shape in its cross section and extending from front to back of the drawing sheet of FIG. 8. The pressure spring 154B is desirably divided into two springs so as to press the columnar pressure member 155B evenly in a leftward direction of FIG. 8. Accordingly, the pressure member 155B is laterally slidable along the columnar projection portion 158.

Further, in this embodiment, the pressure spring 154B and the pressure member 155B are inserted to the connector housing 1503, and then the contact terminals 1603 connected to the wire harness 140 (see FIG. 1) in advance are inserted from left to right of FIG. 8 so as to be integrated with the connector housing 1503.

When the wire harness 140 is long and the insertion of the contact terminals 160B from the left is therefore inefficient, however, similarly to the case of FIG. 4, the wire harness 140 having cap-shaped terminals at one end thereof may be press-fitted to wire holding portions formed on the contact terminals 160B.

As illustrated in FIG. 11A, each contact terminal 160B includes a press-fitting and fixing portion 161B received and held in the terminal holding portion 156B of the connector housing 150B and connected to the wire harness serving as the external connection conductor 140 in advance, a first member 163B coupled to the press-fitting and fixing portion 161B through intermediation of an elastically deformable portion 162B having a U-shaped structure, a second member 164B being coupled to the first member 163B through intermediation of a U-shaped folding portion and including a conductive contact portion 165B formed at the coupling portion, and a pressure bending portion 168B bent into a V-shape and coupled to a terminal end portion of the second member 164B through intermediation of a stamped reinforcement portion 167B.

Note that, the contact terminal 160B is a copper alloy, as typified by brass excellent in conductivity and spring property, caoted by an oxidation-resistant material after a bending process, the oxidation-resistant material is gold or the oxidation-resistant material is gold as a main component. At a part ranging from the first member 163B to the second member 164B, a reinforcement rib 166B is formed by stamping the center into a circular-arc shape, and the conductive contact portion 165B has a stamped circular-arc surface formed at the folding and coupling portion between the first member 163B and the second member 164B. The elastic strength of the contact terminal 160B is adjusted based on a length of the reinforcement rib 166B at a part positioned in the second member 164B and a bending height of the rib or a stamping depth of the rib.

In FIG. 9, which is a sectional view illustrating a state in the middle of insertion of the connector housing 150B, when the connector housing 150B is mounted on the circuit board 130, after elapse of a predetermined dead travel period, an end surface of an end surface covering resin 112B abuts against a first abutment position corresponding to a distal end of the pressure bending portion 168B, whereas a second abutment position corresponding to an intermediate portion of the pressure bending portion 168B abuts against a base of the trapezoid of the pressure member 155B.

When the connector housing 150B is further moved, the contact terminal 160B starts to be pivoted counterclockwise with the second abutment position as a fulcrum.

In FIG. 10, which is a sectional view illustrating a state at the completion of insertion of the connector housing 150B, the conductive contact portion 165B (see FIGS. 11A and 11B) of the contact terminal 160B is brought into electrical contact with the board-side terminal 131.

At this time, the pressing force of the pressure member 155B is applied to the plurality of contact terminals 160B in a distributed manner, but the contact pressure between each conductive contact portion 165B and the board-side terminal 131 fluctuates depending on, for example, fluctuation in V-shaped bending angle of the pressure bending portion 168B. In order to reduce the fluctuation amount, the second member 164B and the pressure bending portion 1683 are adjusted so as to have appropriate elasticity.

Further, in the state of FIG. 10, the elastically deformable portion 162B (see FIGS. 11A and 11B) of the contact terminal 160B acts in a direction of diminishing the contact pressure between the conductive contact portion 165B and the board-side terminal 131. However, the elastically deformable portion 162B is configured to return the contact terminal 160B to a released state of FIG. 8, and has no torque loss that may be caused by a pivoting mechanism. Therefore, it is only necessary that the elastically deformable portion 162B be lightweight to such a degree that the elastically deformable portion 162B may withstand the weight of the contact terminal 160B.

Thus, the pressing force of the pressure spring 154B is converted substantially orthogonally by the pressure bending portion 168B, and is utilized efficiently and effectively as the contact pressure applied at the conductive contact portion 165B. Further, a force component for causing a slide in a plane direction is also suppressed greatly between the conductive contact portion 165B and the board-side terminal 131.

In FIG. 11A, which is a side view illustrating the contact terminal 160B, the above-mentioned press-fitting and fixing portion 161B includes the wire holding portion 161*a* for embracing and holding an insulation coating portion formed at one end of the wire harness 140 (see FIG. 1), the wire holding portion 161*b* to which an exposed wire core portion is soldered, and the terminal holding portion 161*c* for fixing the entire contact terminal 160B to the terminal holding portion 156B of the connector housing 150B.

In FIG. 11B, which is a developed view illustrating the contact terminal 160B, clipping circular-arc portions 180 and 181 correspond to circular-arc portions for holding the end portion of the wire harness 140 and connecting the wire core portion by clamping. A circular-arc elastic portion 182 corresponds to a circular-arc portion serving as the elastically deformable portion 162B. A circular-arc folding portion 183 corresponds to a circular-arc portion formed between the first member 163B and the second member 164B.

In the above description, the elastically deformable portion 162B has the U-shape. In place of the U-shape, the elastically deformable portion may have a V-shape or a W-shape.

Similarly, the folding and coupling portion between the first member 163B and the second member 164B may have a V-shape in place of the U-shape.

Further, the pressure spring 154B and the pressure member 155B may be held by the center recess portion 153 as illustrated in FIG. 4 instead of being held by the columnar projection portion 158.

Further, in a natural state, as illustrated in FIG. 10, the elastically deformable portion 162B of the contact terminal 160B may be configured to generate a spring force in a direction of bringing the conductive contact portion 165B into pressure contact with the board-side terminal 131. When the connector housing 150B is removed, the pressure bending portion 168B may be pressed by the pressure spring 154B and the entire contact terminal 160B may therefore be pivoted clockwise so that the contact terminal 160B is brought into the released state of FIG. 8.

(2) Summary and Feature of Second Embodiment

As is apparent from the above description, an electronic device unit 100B according to the second embodiment of the present invention is constructed as follows.

The electronic device unit 100B includes the connector housing 150B provided to the plurality of board-side terminals 131 formed on at least one of both end surfaces of the circuit board 130. The connector housing 150B has connected at one end thereof the external connection conductor 140 being the wire harness or the wiring board, and includes at another end thereof the plurality of contact terminals 160B brought into electrical contact with the board-side terminals 131. The connector housing 150B is mounted on the circuit board 130 in a removable manner.

The contact terminal 160B includes: the press-fitting and fixing portion 161B received and held in the terminal holding portion 156B formed in the connector housing 150B and connected to the external connection conductor 140 in advance; the first member 163B coupled to the press-fitting and fixing portion 161B through intermediation of the elastically deformable portion 162B having the U-shaped structure; the second member 164B being coupled to the first member 163B through intermediation of the U-shaped folding portion and including the conductive contact portion 165B formed at the coupling portion; and the pressure bending portion 168B bent into the V-shape and coupled to the terminal end portion of the second member 164B through intermediation of the stamped reinforcement portion 167B.

Further, the circuit board 130 is molded integrally with the outer resin member 110 being an outer container. The board-side terminals 131 are exposed from the outer resin member 110. The circuit board 130 includes the end surface covering resin 112B formed at the distal end portion of the board end portion, on which the board-side terminals 131 are formed, and communicated to the outer resin member 110. The connector housing 1508 is mounted with the mounting reference point, which is arranged on the outer resin member 110, as the reference position.

The end surface covering resin 112B is molded integrally with the outer resin member 110 so that the position of the outer side surface of the end surface covering resin 112B is arranged at the predetermined reference dimension L0 from the mounting reference point of the connector housing 150B.

The end surface covering resin 1128 is configured to push back, when the connector housing 150B is mounted on the circuit board 130 through intermediation of the outer resin member 110, after elapse of the predetermined dead travel period, the pressure bending portion 168B of the contact terminal 160B so that the conductive contact portion 165B is brought into pressure contact with the board-side terminal 131.

As described above, in the electronic device unit 1008 according to the present invention, the plurality of board-side terminals 131 are formed at the end portion of the circuit board 130, which is exposed from the outer resin member 110, and the connector housing 150B, which accommodates the contact terminals 160B electrically connected to the board-side terminals 131, is mounted on the electronic device unit 100B in a removable manner. Each of the contact terminals 160B includes the first member 163B coupled to the press-fitting and fixing portion 161B through intermediation of the elastically deformable portion 162B, and the second member 164B being coupled to the first member 163B through intermediation of the folding portion and including the pressure bending portion 168B formed at the terminal end of the second member 164B. The end surface covering resin 112B formed on the circuit board 130 pushes back the pressure bending portion 168B so that the conductive contact portion 165B formed at the folding portion of the first member 163B is pressed against the board-side terminal 131.

In particular, according to the second embodiment, the dimension of the end surface covering resin 112B in a vertical direction (direction of the thickness of the circuit board 130) is large, and hence, even when the upper and lower contact terminals 160B are arranged at the same positions in vertical alignment, the pressure bending portions 168B of the upper and lower contact terminals 160B do not interfere with each other. Accordingly, there is a remarkable feature in that the board-side terminals 131 formed on the front and back of the circuit board 130 do not need to be arranged alternately in a staggered manner.

The connector housing 150B includes the tubular peripheral wall member 151 and the bottom wall member 152.

The tubular peripheral wall member 151 includes the elastic hook member 157 engageable with the retaining projection 117 corresponding to the mounting reference point on the outer resin member 110.

The bottom wall member 152 has the through-hole through which the connection lead terminal to be connected to the external connection conductor 140 being the wire harness is drawn out, or the through-hole through which the connection lead terminal to be connected to the external connection conductor 140 being the wiring board is drawn out.

The bottom wall member 152 further has the terminal holding portion 156B to which the press-fitting and fixing portion 161B of the contact terminal 160B is press-fitted and fixed, and the columnar projection portion 158 or the center recess portion 153 in which the pressure member 155B biased by the pressure spring 154B in a push-out relationship is inserted.

A distal end of the pressure bending portion 168B, which is bent into the V-shape from the second member 164B of the contact terminal 160B, corresponds to the first abutment position where the pressure bending portion 168B is pushed back by the end surface covering resin 112B.

The pressure member 155B has the trapezoidal shape in cross section, and the base of the trapezoid corresponds to the second abutment position where the pressure bending portion 168B is pressed.

When the connector housing 150B is mounted on the circuit board 130 through intermediation of the outer resin member 110, after elapse of the predetermined dead travel period, the end surface covering resin 112B pushes back the first abutment position of the pressure bending portion 168B to pivot the second member 164B with the second abutment position of the pressure member 155B as a fulcrum so that the conductive contact portion 165B is brought into pressure contact with the board-side terminal 131.

As described above, according to claim 3 of the present invention, the pressure bending portion of the contact terminal is pressed by the connector housing through intermediation of the pressure spring and the second abutment position of the pressure member, and the first abutment position of the pressure bending portion is pushed back by the end surface covering resin on the circuit board side so that the conductive contact portion is brought into pressure contact with the board-side terminal.

Thus, the conductive contact portion is brought into pressure contact with the board-side terminal substantially in the right-angle direction so that no slide or slip occurs. Accordingly, there is a feature in that a predetermined pressure regulated by the pressure spring is obtained as the pressure for the pressure contact.

Third Embodiment

(1) Details of Structure and Action

Figure 12:
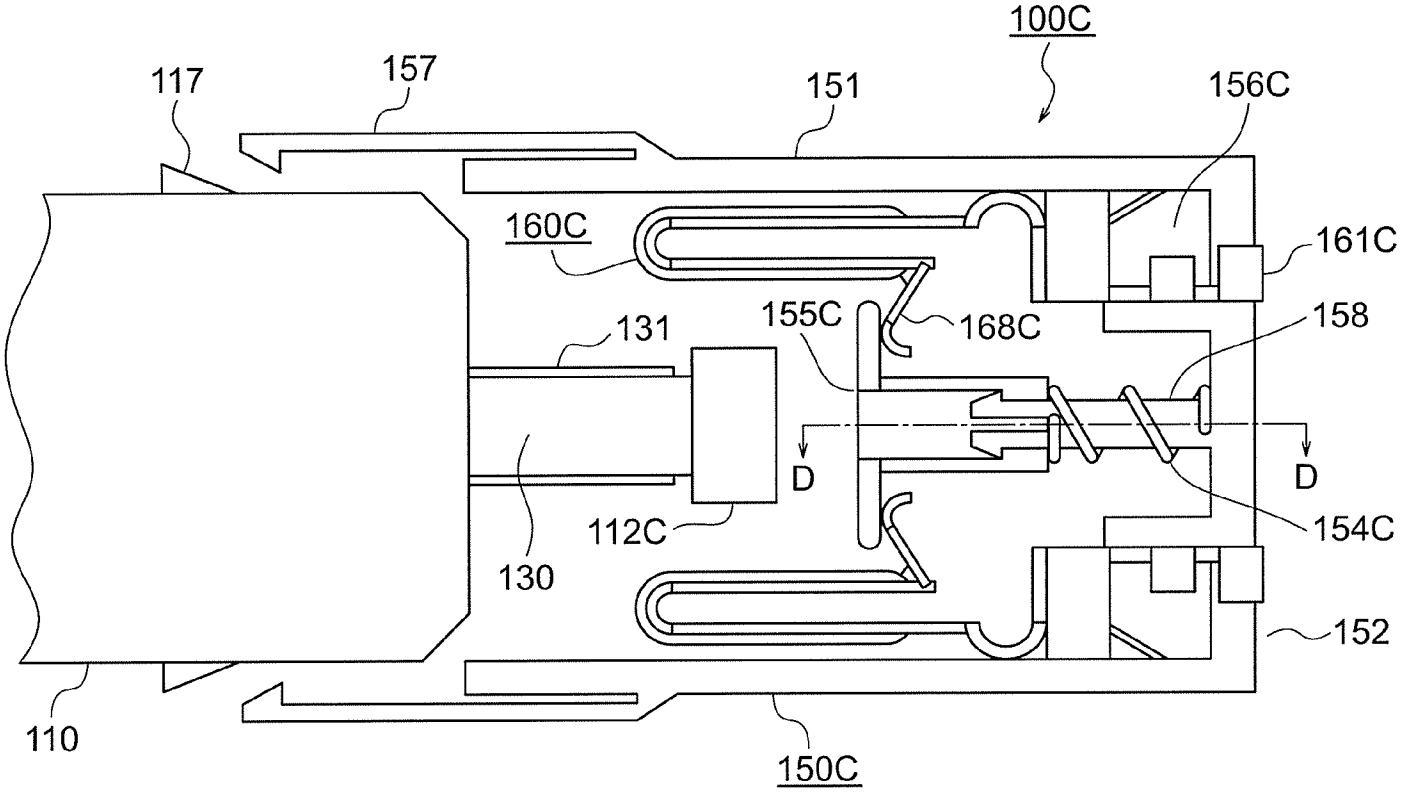
FIG. 12 is a sectional view illustrating a state at the start of insertion of a connector housing of an electronic device unit according to a third embodiment of the present invention.
Figure 13:
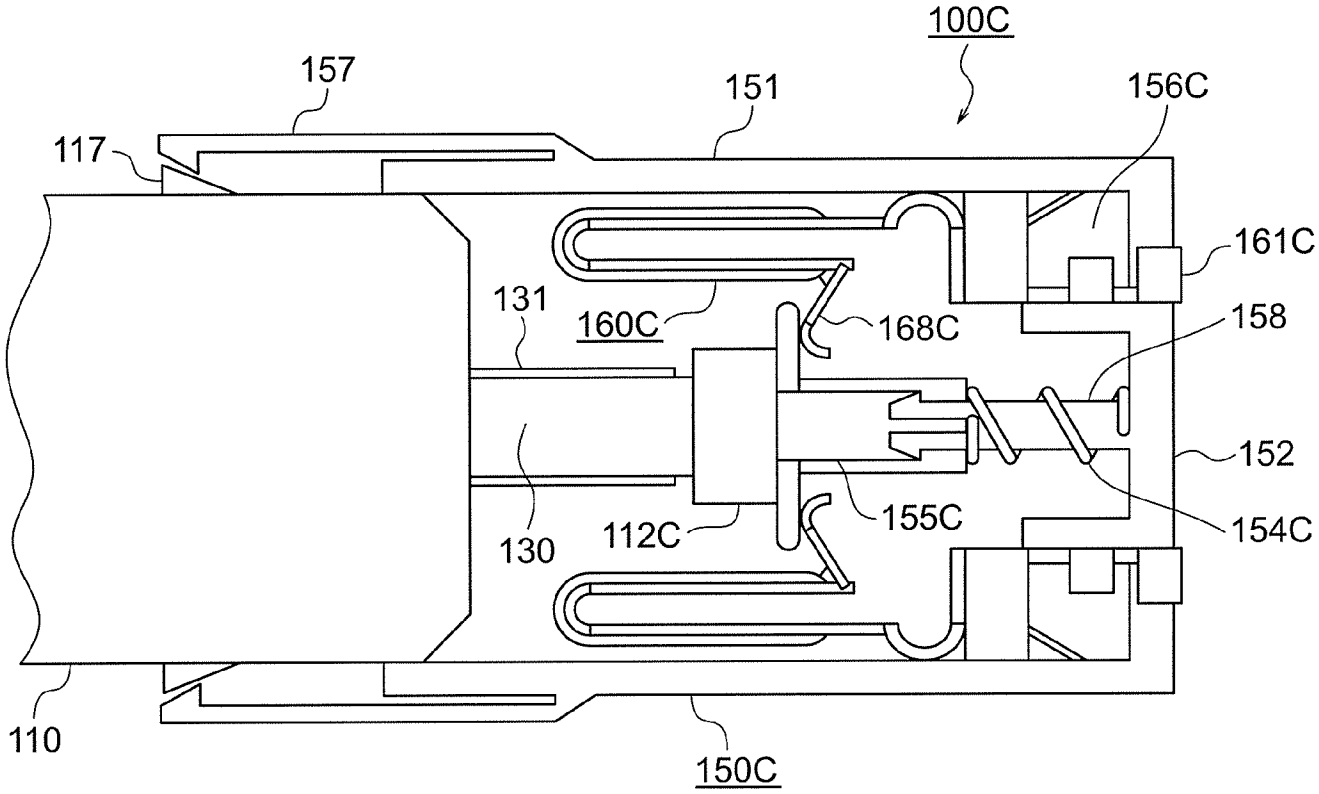
FIG. 13 is a sectional view illustrating a state in the middle of insertion of the connector housing of the electronic device unit of FIG. 12.
Figure 14:
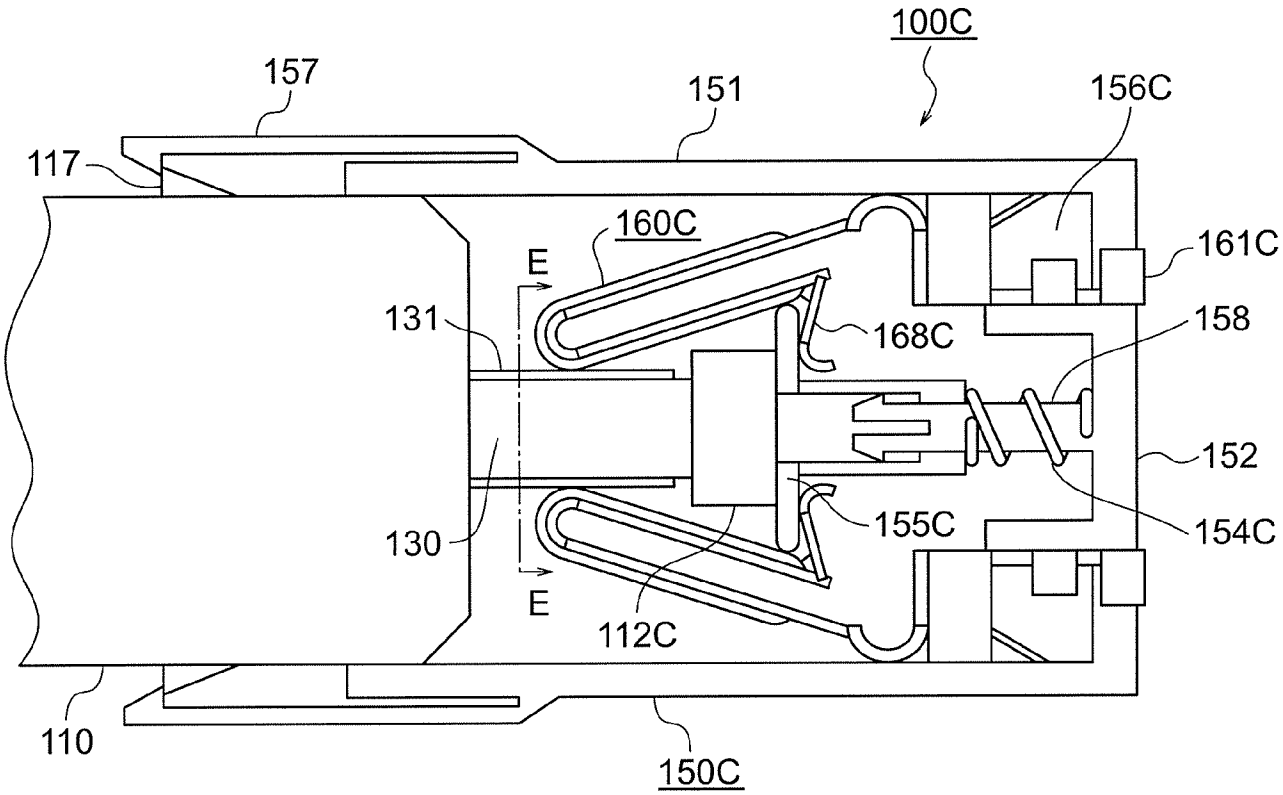
FIG. 14 is a sectional view illustrating a state at the completion of insertion of the connector housing of the electronic device unit of FIG. 12.
Figure 15:
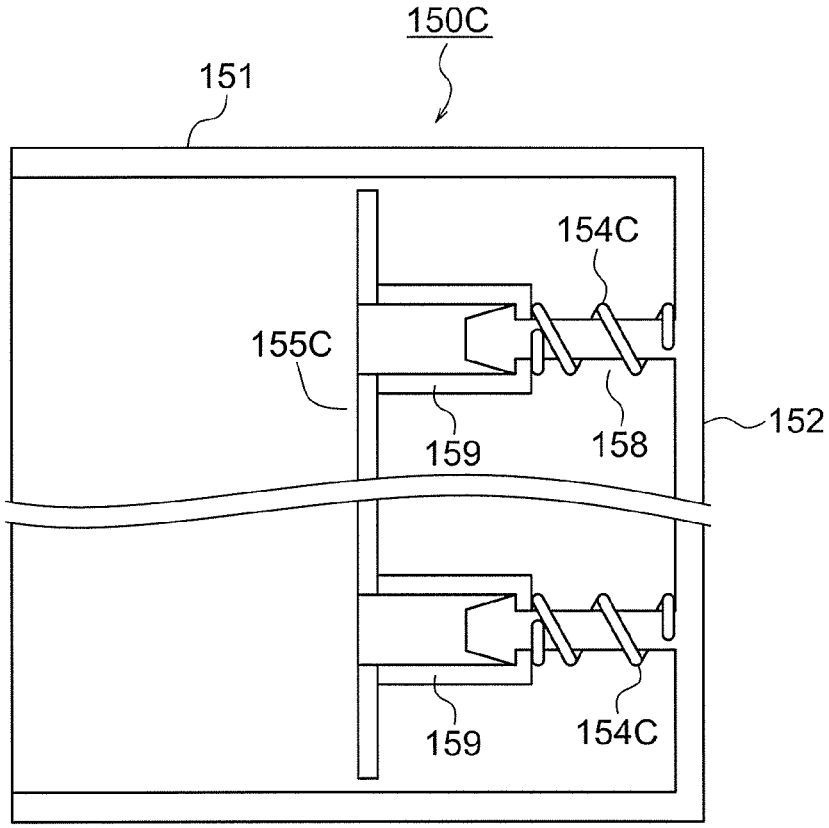
FIG. 15 is a partial detailed view illustrating the electronic device unit of FIG. 12 as seen in a direction indicated by the arrow D-D.
Figure 16A:
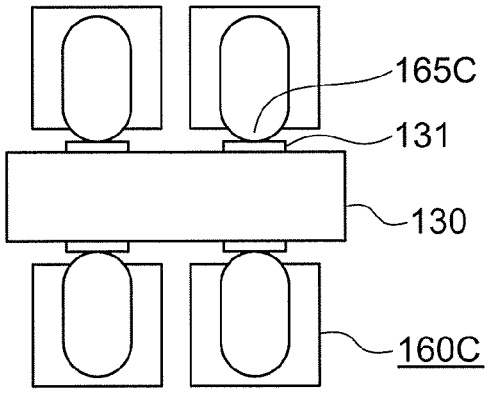
FIG. 16A is a partial detailed view illustrating a first example of the electronic device unit of FIG. 14 as seen in a direction indicated by the arrow E-E.
Figure 16B:
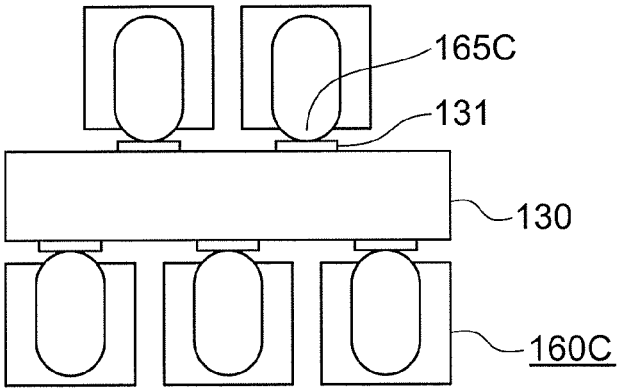
FIG. 16B is a partial detailed view illustrating a second example of the electronic device unit of FIG. 14 as seen in a direction indicated by the arrow E-E.
Figure 17A:
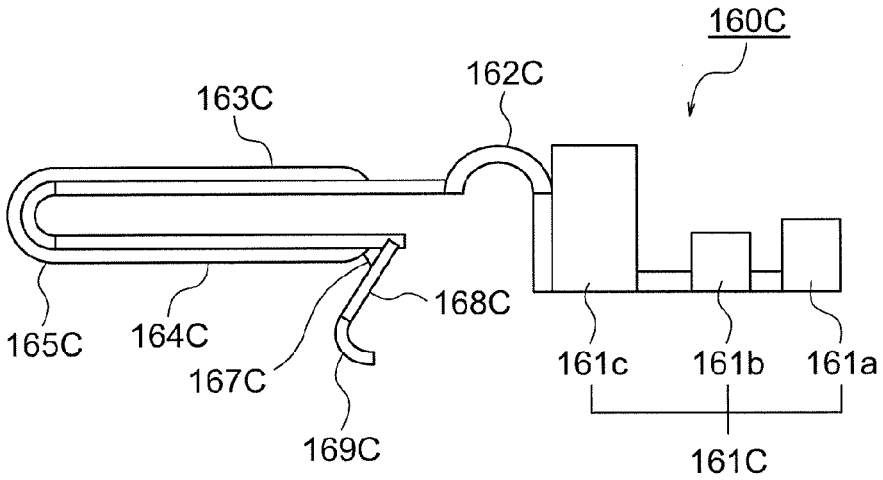
FIG. 17A is a side view illustrating a contact terminal of the electronic device unit of FIG. 12.
Figure 17B:
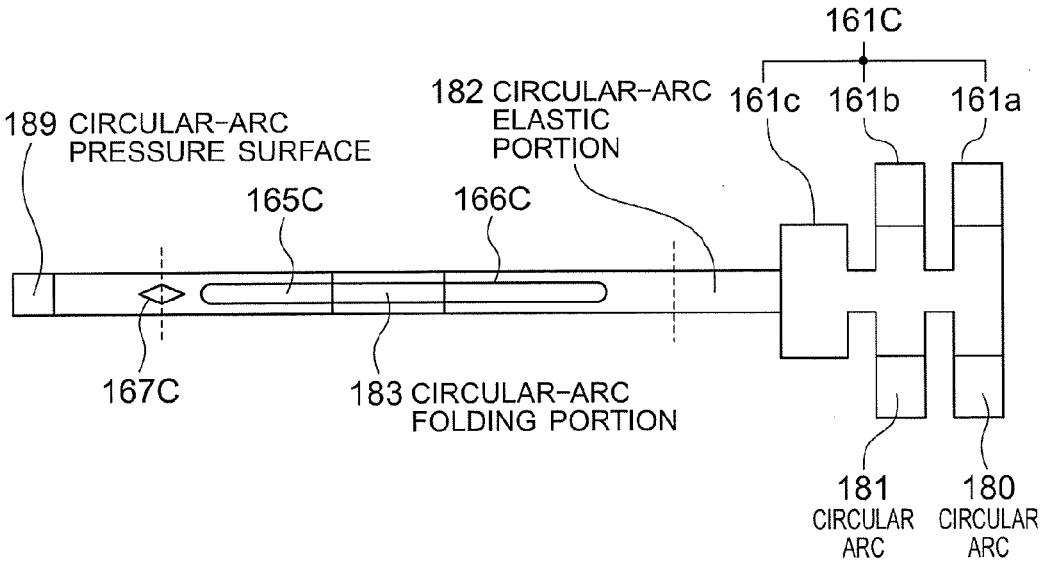
FIG. 17B is a developed view illustrating the contact terminal of the electronic device unit of FIG. 12.

Now, focusing on differences from FIGS. 1 to 7B, detailed descriptions are made of FIG. 12, which is a sectional view illustrating a state at the start of insertion of a connector housing of an electronic device unit according to a third embodiment of the present invention, FIG. 13, which is a sectional view illustrating a state in the middle of insertion of the connector housing, FIG. 14, which is a sectional view illustrating a state at the completion of insertion of the connector housing, FIG. 15, which is a partial detailed view as seen in a direction indicated by the arrow D-D of FIG. 12, FIGS. 16A and 16B, which are partial detailed views as seen in a direction indicated by the arrow E-E of FIG. 14, and FIGS. 17A and 17B, which are a side view and a developed view illustrating a contact terminal.

Note that, in the figures, the same reference symbols represent the same or corresponding parts.

FIG. 12 illustrates a state in which a distal end locking portion of each elastic hook member 157 of a connector housing 150C is positioned sufficiently away from the retaining projection 117 of the outer resin member 110 and the connector housing 150C starts to be inserted to the board-side terminals 131 of the circuit board 130.

The connector housing 150C includes the tubular peripheral wall member 151 and the bottom wall member 152. The tubular peripheral wall member 151 includes the elastic hook members 157, and the bottom wall member 152 includes terminal holding portions 156C to which contact terminals 160C are press-fitted and fixed, and the columnar projection portion 158 to which a pressure member 155C and a pressure spring 154C described later are inserted.

Note that, the pressure member 155C is a strip-shaped resin molded product having a thin-plate shape in its cross section and extending from front to back of the drawing sheet of FIG. 12. The pressure spring 154C is desirably divided into two springs so as to press the strip-shaped pressure member 155C evenly in a leftward direction of FIG. 12. Accordingly, the pressure member 155C is laterally slidable along the columnar projection portion 158.

Further, in this embodiment, the contact terminals 160C connected to the wire harness 140 (see FIG. 1) in advance are inserted from left to right of FIG. 12, and then the pressure spring 154C and the pressure member 155C are inserted to the connector housing 150C so as to be integrated with the connector housing 150C.

When a window hole for allowing a pressure bending portion 168C to pass therethrough is formed in the bottom wall member 152 of the connector housing 150C, however, the contact terminal 160C may be inserted from right to left of FIG. 12. As a result, the workability is enhanced when an elongated wire harness 140 is provided.

Alternatively, as described with reference to FIG. 4, the wire harness 140 having cap-shaped terminals at one end thereof may be press-fitted to wire holding portions formed on the contact terminals 160C.

As illustrated in FIG. 17A, each contact terminal 160C includes a press-fitting and fixing portion 161C received and held in the terminal holding portion 156C of the connector housing 150C and connected to the wire harness serving as the external connection conductor 140 in advance, a first member 163C coupled to the press-fitting and fixing portion 161C through intermediation of an elastically deformable portion 162C having a U-shaped structure, a second member 164C being coupled to the first member 163C through intermediation of a U-shaped folding portion and including a conductive contact portion 165C formed at the coupling portion, and a pressure bending portion 168C bent into a V-shape and coupled to a terminal end portion of the second member 164C through intermediation of a stamped reinforcement portion 167C. Further, the pressure bending portion 168C has a circular-arc pressure contact surface 169C at a distal end thereof.

Note that, the contact terminal 160C is a copper alloy, as typified by brass excellent in conductivity and spring property, caoted by an oxidation-resistant material after a bending process, the oxidation-resistant material is gold or the oxidation-resistant material is gold as a main component. At a part ranging from the first member 163C to the second member 164C, a reinforcement rib 166C is formed by stamping the center into a circular-arc shape, and the conductive contact portion 165C has a stamped circular-arc surface formed at the folding and coupling portion between the first member 163C and the second member 164C. The elastic strength of the contact terminal 160C is adjusted based on a length of the reinforcement rib 166C at a part positioned in the second member 164C and a bending height of the rib or a stamping depth of the rib.

In FIG. 13, which is a sectional view illustrating a state in the middle of insertion of the connector housing 150C, when the connector housing 150C is mounted on the circuit board 130, after elapse of a predetermined dead travel period, an end surface of an end surface covering resin 112C abuts against an opposed end surface of the pressure member 155C, whereas a back surface of the pressure member 155C abuts against the pressure contact surface 169C of the pressure bending portion 1680.

When the connector housing 150C is further moved, the contact terminal 160C starts to be pivoted counterclockwise with the pressure contact surface 169C as a fulcrum.

In FIG. 14, which is a sectional view illustrating a state at the completion of insertion of the connector housing 150C, the conductive contact portion 165C (see FIGS. 17A and 17B) of the contact terminal 160C is brought into electrical contact with the board-side terminal 131. At this time, the pressing force of the pressure member 155C is applied to the plurality of contact terminals 160C in a distributed manner, but the contact pressure between each conductive contact portion 165C and the board-side terminal 131 fluctuates depending on, for example, fluctuation in V-shaped bending angle of the pressure bending portion 168C. In order to reduce the fluctuation amount, the second member 164C and the pressure bending portion 168C are adjusted so as to have appropriate elasticity.

Further, in the state of FIG. 14, the elastically deformable portion 162C (see FIGS. 17A and 17B) of the contact terminal 160C acts in a direction of diminishing the contact pressure between the conductive contact portion 165C and the board-side terminal 131. However, the elastically deformable portion 162C is configured to return the contact terminal 160C to a released state of FIG. 12, and has no torque loss that may be caused by a pivoting mechanism. Therefore, it is only necessary that the elastically deformable portion 162C be lightweight to such a degree that the elastically deformable portion 162C may withstand the weight of the contact terminal 160C.

Thus, the pressing force applied to the pressure bending portion 168C is converted substantially orthogonally by the V-shaped bending portion, and is utilized efficiently and effectively as the contact pressure applied at the conductive contact portion 165C. Further, a force component for causing a slide in a plane direction is also suppressed greatly between the conductive contact portion 165C and the board-side terminal 131.

Note that, in this embodiment, the pressure spring 154C is configured to return the pressure member 155C to an initial position of FIG. 12 when the connector housing 150C is removed.

In FIG. 15, which is a sectional view taken along a line indicated by the arrow D-D of FIG. 12, two cylindrical pressure member holding portions 159 are formed on a back surface of the pressure member 155C. The columnar projection portion 158 (see FIG. 12) having a distal end portion split into a cotter pin state is forcibly fitted into each pressure member holding portion 159 so that the columnar projection portion 158 is retained by a small-diameter portion of a cylindrical inner surface of the pressure member holding portion 159.

In FIG. 16A, which is a partial detailed view illustrating a first example of the electronic device unit of FIG. 14 as seen in a direction indicated by the arrow E-E, the board-side terminals 131 formed on the front and back of the circuit board 130 are arranged at the same positions in vertical alignment.

In FIG. 16B, which is a partial detailed view illustrating a second example of the electronic device unit of FIG. 14 as seen in a direction indicated by the arrow E-E, the vertical positions of the board-side terminals 131 formed on the front and back of the circuit board 130 are shifted in a staggered manner.

The reason is as follows. That is, the dimension of the pressure member 155C in a vertical direction (direction of the thickness of the circuit board 130) is large, and hence, even when the upper and lower contact terminals 160C are arranged at the same positions in vertical alignment, the pressure bending portions 168C of the upper and lower contact terminals 160C do not interfere with each other. Accordingly, the board-side terminals 131 formed on the front and back of the circuit board 130 do not need to be arranged alternately in a staggered manner.

In FIG. 17A, which is a side view illustrating the contact terminal 160C, the above-mentioned press-fitting and fixing portion 161C includes the wire holding portion 161*a* for embracing and holding the insulation coating portion formed at one end of the wire harness 140 (see FIG. 1), the wire holding portion 161*b* to which the exposed wire core portion is soldered, and the terminal holding portion 161*c* for fixing the entire contact terminal 160C to the terminal holding portion 156C of the connector housing 1500.

In FIG. 17B, which is a developed view illustrating the contact terminal 160C, the clipping circular-arc portions 180 and 181 correspond to circular-arc portions for holding the end portion of the wire harness 140 and connecting the wire core portion by clamping. The circular-arc elastic portion 182 corresponds to a circular-arc portion serving as the elastically deformable portion 162C. The circular-arc folding portion 183 corresponds to a circular-arc portion formed between the first member 163C and the second member 164C.

Note that, it is important that the elastically deformable portion 1620 of this embodiment has the U-shape. When the connector housing 150C is to be pushed from right to left in the state of FIG. 13, the elastically deformable portion 162C is not buckled due to the fact that the distal end portion of the contact terminal 160C is pushed back by the end surface covering resin 112C through intermediation of the pressure member 155C.

Therefore, the U-shaped outer surface of the elastically deformable portion 162C abuts against the inner surface of the tubular peripheral wall member 151 and the press-fitting and fixing portion 161C (specifically, the terminal holding portion 161*c*) of the contact terminal 160C, to thereby prevent clockwise pivoting about the mounting position.

However, the contact terminal 160C is easily pivoted counterclockwise about the mounting position. Thus, the conductive contact portion 165C abuts against the board-side terminal 131 at the position illustrated in FIG. 14. Note that, the pressure spring 154C and the pressure member 155C may be held by the center recess portion 153 as illustrated in FIG. 4 instead of being held by the columnar projection portion 158.

(2) Summary and Feature of Third Embodiment

As is apparent from the above description, an electronic device unit 100C according to the third embodiment of the present invention includes the connector housing 150C provided to the plurality of board-side terminals 131 formed on at least one of both end surfaces of the circuit board 130. The connector housing 150C has connected at one end thereof the external connection conductor 140 being the wire harness or the wiring board, and includes at another end thereof the plurality of contact terminals 1600 brought into electrical contact with the board-side terminals 131. The connector housing 150C is mounted on the circuit board 130 in a removable manner.

The contact terminal 160C includes: the press-fitting and fixing portion 161C received and held in the terminal holding portion 156C formed in the connector housing 150C and connected to the external connection conductor 140 in advance; the first member 163C coupled to the press-fitting and fixing portion 161C through intermediation of the elastically deformable portion 162C having the U-shaped structure; the second member 164C being coupled to the first member 163C through intermediation of the U-shaped folding portion and including the conductive contact portion 165C formed at the coupling portion; and the pressure bending portion 168C bent into the V-shape and coupled to the terminal end portion of the second member 164C through intermediation of the stamped reinforcement portion 167C.

Further, the circuit board 130 is molded integrally with the outer resin member 110 being an outer container. The board-side terminals 131 are exposed from the outer resin member 110. The circuit board 130 includes the end surface covering resin 112C formed at the distal end portion of the board end portion, on which the board-side terminals 131 are formed, and communicated to the outer resin member 110. The connector housing 150C is mounted with the mounting reference point, which is arranged on the outer resin member 110, as the reference position.

The end surface covering resin 112C is molded integrally with the outer resin member 110 so that the position of the outer side surface of the end surface covering resin 112C is arranged at the predetermined reference dimension L0 from the mounting reference point of the connector housing 150C.

The end surface covering resin 112C is configured to push back, when the connector housing 150C is mounted on the circuit board 130 through intermediation of the outer resin member 110, after elapse of the predetermined dead travel period, the pressure bending portion 168C of the contact terminal 160C so that the conductive contact portion 165C is brought into pressure contact with the board-side terminal 131.

As described above, in the electronic device unit 100C according to the present invention, the plurality of board-side terminals 131 are formed at the end portion of the circuit board 130, which is exposed from the outer resin member 110, and the connector housing 150C, which accommodates the contact terminals 160C electrically connected to the board-side terminals 131, is mounted on the electronic device unit 100C in a removable manner. Each of the contact terminals 160C includes the first member 163C coupled to the press-fitting and fixing portion 161C through intermediation of the elastically deformable portion 1620, and the second member 164C being coupled to the first member 163C through intermediation of the folding portion and including the pressure bending portion 168C formed at the terminal end of the second member 164C. The end surface covering resin 112C formed on the circuit board 130 pushes back the pressure bending portion 168C so that the conductive contact portion 165C formed at the folding portion of the first member 1630 is pressed against the board-side terminal 131.

In particular, according to the third embodiment, the dimension of the pressure member 155C in the vertical direction (direction of the thickness of the circuit board 130) is large, and hence, even when the upper and lower contact terminals 160C are arranged at the same positions in vertical alignment, the pressure bending portions 168C of the upper and lower contact terminals 160C do not interfere with each other. Accordingly, there is a feature in that the board-side terminals 131 formed on the front and back of the circuit board 130 do not need to be arranged alternately in a staggered manner. Further, the dimension of the end surface covering resin 112C in the vertical direction may be small. Therefore, it is possible to prevent damage to a part of the end surface covering resin 112C molded with the circuit board 130 due to a load applied to the end surface covering resin 112C in a pivoting direction when the elastic forces of the upper and lower contact terminals 160C are out of balance.

The connector housing 150C includes the tubular peripheral wall member 151 and the bottom wall member 152.

The tubular peripheral wall member 151 includes the elastic hook member 157 engageable with the retaining projection 117 corresponding to the mounting reference point on the outer resin member 110.

The bottom wall member 152 has the through-hole through which the connection lead terminal to be connected to the external connection conductor 140 being the wire harness is drawn out, or the through-hole through which the connection lead terminal to be connected to the external connection conductor 140 being the wiring board is drawn out.

The bottom wall member 152 further has the terminal holding portion 156C to which the press-fitting and fixing portion 161C of the contact terminal 160C is press-fitted and fixed, and the columnar projection portion 158 or the center recess portion 153 in which the pressure member 155C biased by the pressure spring 154C in a push-out relationship is inserted.

The circular-arc pressure contact surface 169C to be pushed back by the back surface of the pressure member 155C is formed at the distal end position of the pressure bending portion 1680, which is bent into the V-shape from the second member 164C of the contact terminal 160C.

When the connector housing 150C is mounted on the circuit board 130 through intermediation of the outer resin member 110, after elapse of the predetermined dead travel period, the end surface covering resin 112C and the front surface of the pressure member 155C abut against each other and the back surface of the pressure member 155C pushes back the pressure contact surface 169C so that the conductive contact portion 165C is brought into pressure contact with the board-side terminal 131.

As described above, according to claim 5 of the present invention, when the connector housing is mounted, the pressure bending portion of the contact terminal is pressed through intermediation of the end surface covering resin on the circuit board side and the pressure member so that the conductive contact portion of the contact terminal is brought into pressure contact with the board-side terminal.

Thus, the conductive contact portion is brought into pressure contact with the board-side terminal substantially in the right-angle direction so that no slide or slip occurs. Accordingly, there is a feature in that a predetermined pressure regulated by the elasticity of the entire contact terminal is obtained as the pressure for the pressure contact.

Note that, the contact pressure between the conductive contact portion and the board-side terminal is determined based on the elasticity of the entire contact terminal, and the pressure spring is configured to determine the initial position of the pressure member.

Further, when the connector housing is moved back and forth due to vibrations during actual operation of the electronic device unit, the pressing force is not applied from the connector housing side to the pressure bending portion. Accordingly, there is a feature in that the sliding friction between the conductive contact portion and the board-side terminal can be suppressed.

The elastically deformable portion 162C holds the entire contact terminal 160C at a released initial position, to thereby avoid contact between the conductive contact portion 165C and the board-side terminal 131 within the predetermined dead travel period of the connector housing 150C, which is taken until the pressure bending portion 168C is pushed back by the end surface covering resin 112C.

The outer peripheral surface of the elastically deformable portion 162C abuts against the press-fitting and fixing portion 161C and the inner wall surface of the tubular peripheral wall member 151. When the pressure bending portion 168C is pushed back by the end surface covering resin 112C, the elastically deformable portion 162C is easily curved so that the first member 163C and the second member 164C are pivoted forward, whereas the elastically deformable portion 162C is prevented from being compressed and deformed in a retreated manner.

Under a state in which the conductive contact portion 165C and the board-side terminal 131 are brought into pressure contact with each other, a relationship among a contact pressure P0 to be diminished by the elastically deformable portion 162C, a contact pressure P1 to be limited by elasticity of the contact terminal 160C, and an effective contact pressure P1-P0 is 21-20>20.

As described above, according to claim 7 of the present invention, the contact terminal does not have a sliding rotational shaft, and is fixed through intermediation of the elastically deformable portion. Therefore, the contact pressure between the conductive contact portion and the board-side terminal, which is diminished by the elastically deformable portion, exhibits a sufficiently smaller value than the contact pressure generated by the pressure spring.

Thus, the contact terminal is separated away and retreated in a natural state, and the contact terminal can easily be inserted beyond the end surface covering resin at the time of mounting the connector housing. Accordingly, there is a feature in that the pressing force of the pressure spring is utilized effectively so that the conductive contact portion can be brought into pressure contact with the board-side terminal.

Further, there is a feature in that it is possible to prevent the sliding friction that may be caused by the shift of the contact point between the conductive contact portion and the board-side terminal when the elastically deformable portion is deformed in a retreated manner due to buckling despite a small pressing force diminished by the elastically deformable portion.

The same applies to the fourth embodiment of the present invention described later.

Fourth Embodiment

(1) Details of Structure and Action

Figure 18:
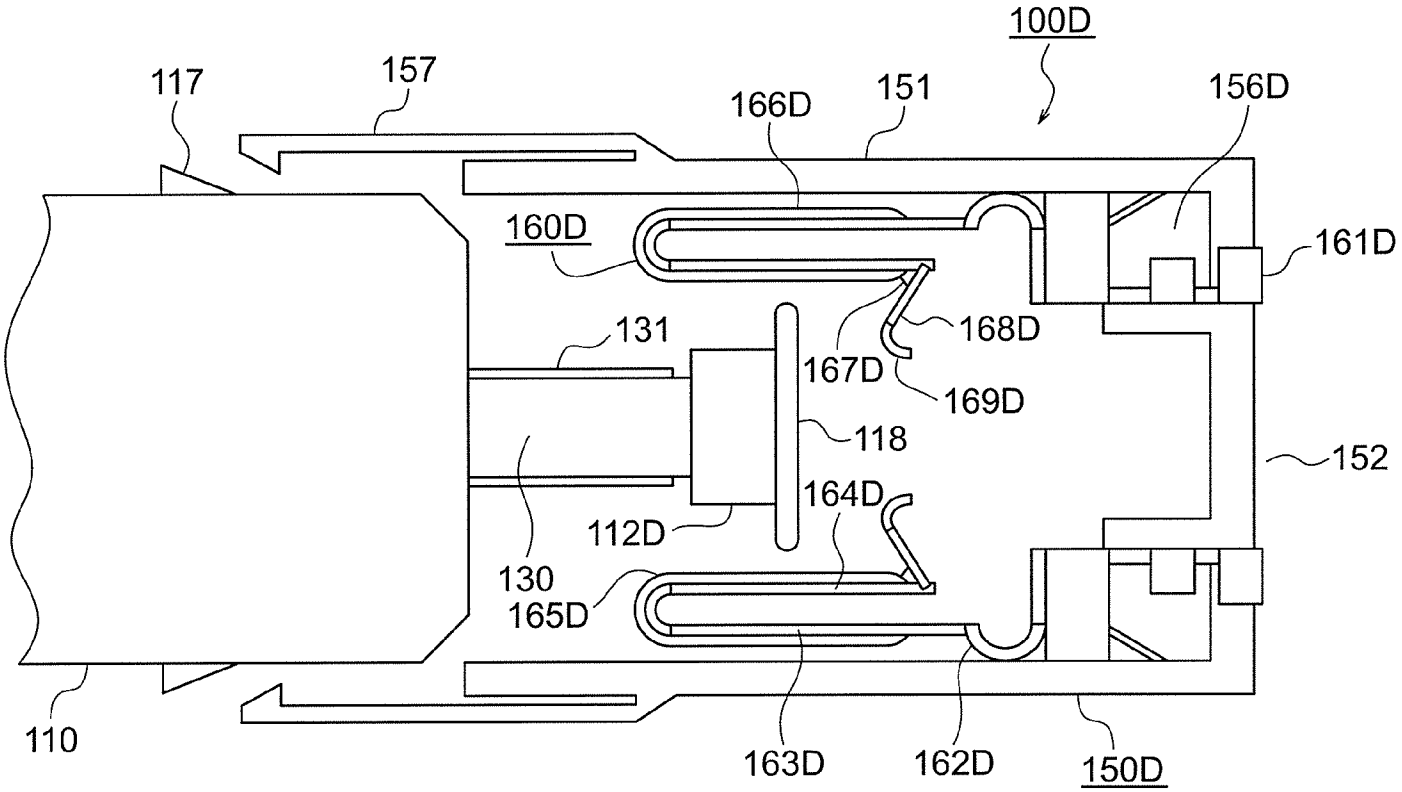
FIG. 18 is a sectional view illustrating a state at the start of insertion of a connector housing of an electronic device unit according to a fourth embodiment of the present invention.
Figure 19:
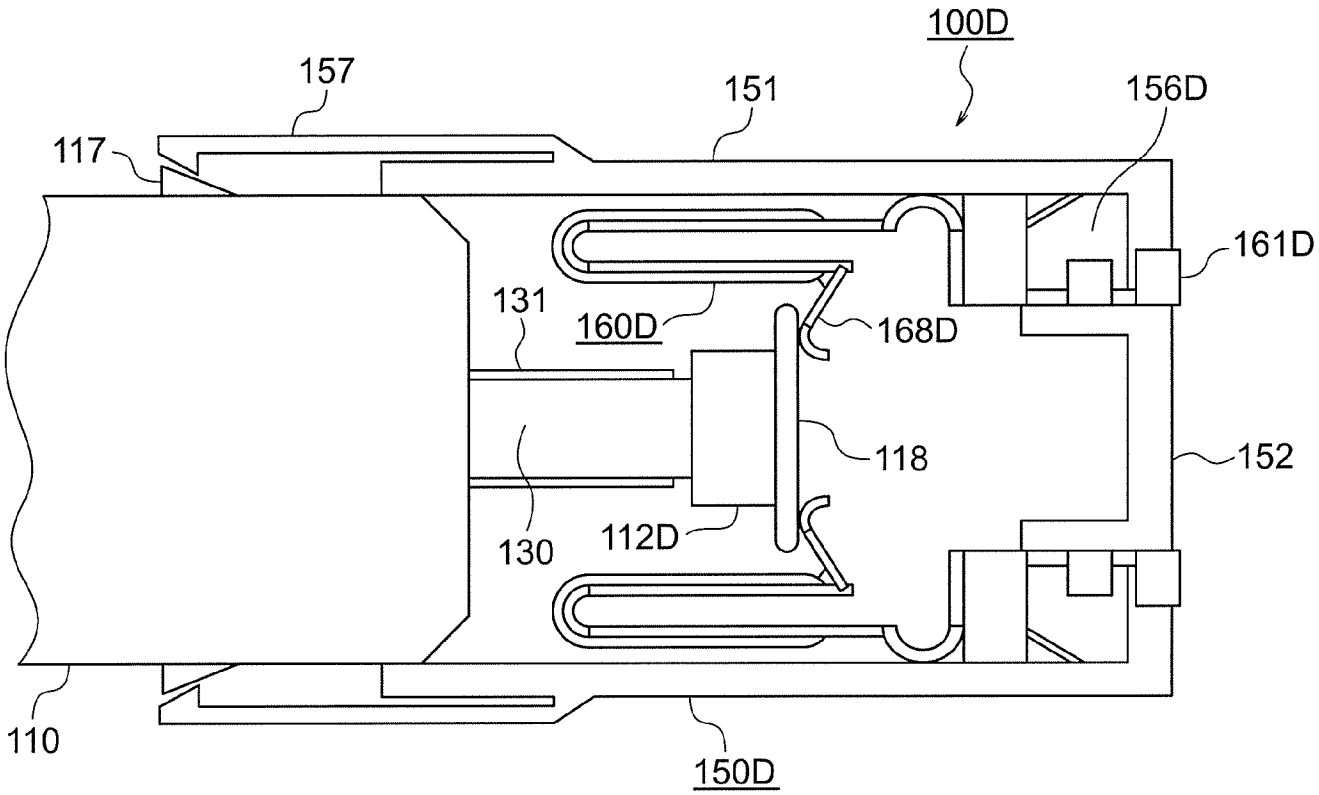
FIG. 19 is a sectional view illustrating a state in the middle of insertion of the connector housing of the electronic device unit of FIG. 18.
Figure 20:
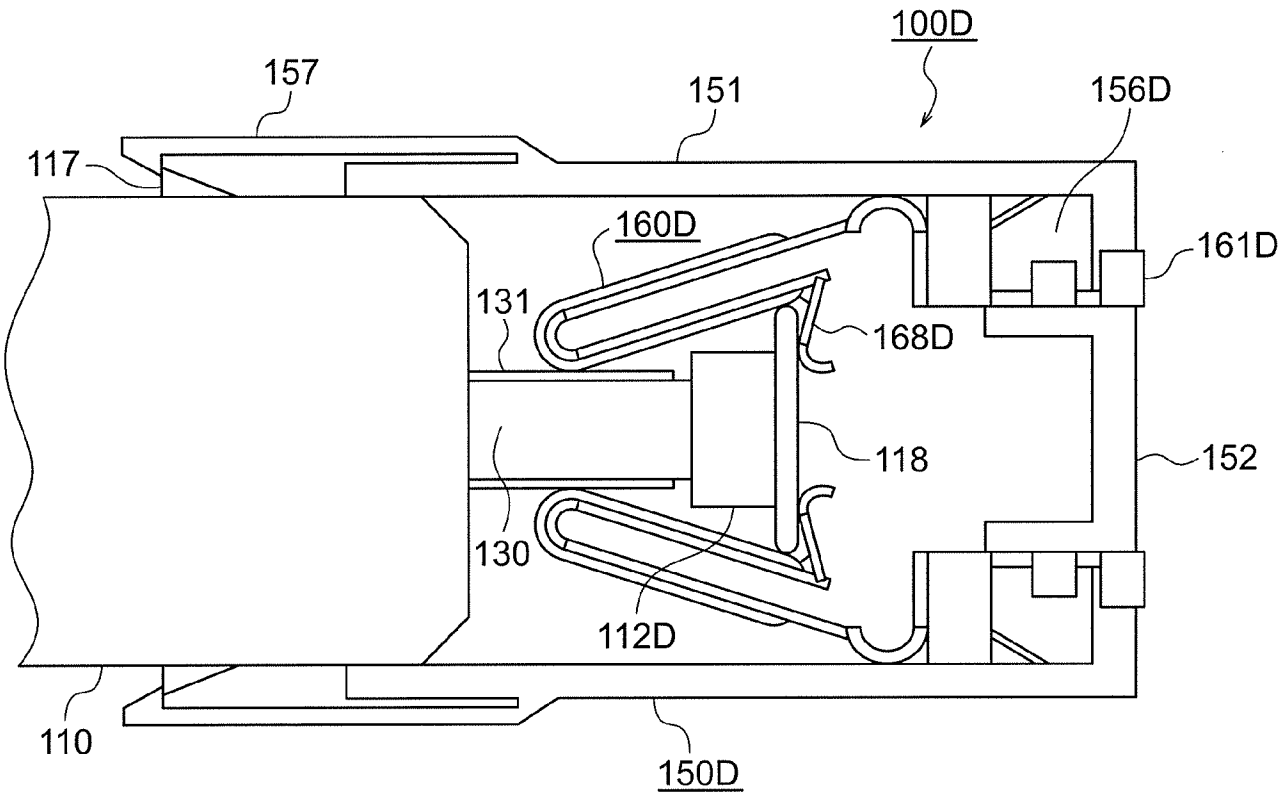
FIG. 20 is a sectional view illustrating a state at the completion of insertion of the connector housing of the electronic device unit of FIG. 18.

Now, focusing on differences from FIGS. 1 to 7B, detailed descriptions are made of FIG. 18, which is a sectional view illustrating a state at the start of insertion of a connector housing of an electronic device unit according to a fourth embodiment of the present invention, FIG. 19, which is a sectional view illustrating a state in the middle of insertion of the connector housing, and FIG. 20, which is a sectional view illustrating a state at the completion of insertion of the connector housing.

Note that, a contact terminal 160D as used in this embodiment is identical to the contact terminal 160C illustrated in FIGS. 17A and 17B. In the figures, the same reference symbols represent the same or corresponding parts.

FIG. 18 illustrates a state in which a distal end locking portion of each elastic hook member 157 of a connector housing 150D is positioned sufficiently away from the retaining projection 117 of the outer resin member 110 and the connector housing 150D starts to be inserted to the board-side terminals 131 of the circuit board 130.

The connector housing 150D includes the tubular peripheral wall member 151 and the bottom wall member 152. The tubular peripheral wall member 151 includes the elastic hook members 157, and the bottom wall member 152 includes terminal holding portions 156D to which contact terminals 160D are press-fitted and fixed.

Note that, in this embodiment, the contact terminals 160D connected to the wire harness 140 (see FIG. 1) in advance are inserted from left to right of FIG. 18.

When the wire harness 140 has a long dimension, however, similarly to the case of FIG. 12, the contact terminals 160D may be inserted from right to left, or the wire harness having the cap-shaped terminals may be employed.

Further, a wide portion 118 is formed on an end surface covering resin 112D that is formed on the end surface of the circuit board 130.

As illustrated in FIG. 17A, each contact terminal 160D includes a press-fitting and fixing portion 161D received and held in the terminal holding portion 156D of the connector housing 150D and connected to the wire harness serving as the external connection conductor 140 in advance, a first member 163D coupled to the press-fitting and fixing portion 161D through intermediation of an elastically deformable portion 162D having a U-shaped structure, a second member 164D being coupled to the first member 163D through intermediation of a U-shaped folding portion and including a conductive contact portion 165D formed at the coupling portion, and a pressure bending portion 168D bent into a V-shape and coupled to a terminal end portion of the second member 164D through intermediation of a stamped reinforcement portion 167D. Further, the pressure bending portion 168D has a circular-arc pressure contact surface 169D at a distal end thereof.

Note that, the contact terminal 160D is a copper alloy, as typified by brass excellent in conductivity and spring property, caoted by an oxidation-resistant material after a bending process, the oxidation-resistant material is gold or the oxidation-resistant material is gold as a main component. At a part ranging from the first member 163D to the second member 164D, a reinforcement rib 166D is formed by stamping the center into a circular-arc shape, and the conductive contact portion 165D has a stamped circular-arc surface formed at the folding and coupling portion between the first member 163D and the second member 164D. The elastic strength of the contact terminal 160D is adjusted based on a length of the reinforcement rib 166D at a part positioned in the second member 164D and a bending height of the rib or a stamping depth of the rib.

In FIG. 19, which is a sectional view illustrating a state in the middle of insertion of the connector housing 150D, when the connector housing 150D is mounted on the circuit board 130, after elapse of a predetermined dead travel period, an outer surface of the wide portion 118 formed on the end surface covering resin 112D abuts against the pressure contact surface 169D corresponding to the distal end portion of the contact terminal 160D. When the connector housing 150D is further moved, the contact terminal 160D starts to be pivoted counterclockwise with the pressure contact surface 169D as a fulcrum.

In FIG. 20, which is a sectional view illustrating a state at the completion of insertion of the connector housing 150D, the conductive contact portion 165D (see FIGS. 17A, 17B, and 18) of the contact terminal 160D is brought into electrical contact with the board-side terminal 131. At this time, the pressing force of the wide portion 118 is applied to the plurality of contact terminals 160D in a distributed manner, but the contact pressure between each conductive contact portion 165D and the board-side terminal 131 fluctuates depending on, for example, fluctuation in V-shaped bending angle of the pressure bending portion 168D. In order to reduce the fluctuation amount, the second member 164D and the pressure bending portion 168D are adjusted so as to have appropriate elasticity.

Further, in the state of FIG. 20, the elastically deformable portion 162D (see FIGS. 17A, 17B, and 18) of the contact terminal 160D acts in a direction of diminishing the contact pressure between the conductive contact portion 165D and the board-side terminal 131. However, the elastically deformable portion 162D is configured to return the contact terminal 160D to a released state of FIG. 18, and has no torque loss that may be caused by a pivoting mechanism. Therefore, it is only necessary that the elastically deformable portion 162D be lightweight to such a degree that the elastically deformable portion 162D may withstand the weight of the contact terminal 160D.

Thus, the pressing force applied to the pressure bending portion 168D is converted substantially orthogonally by the V-shaped bending portion, and is utilized efficiently and effectively as the contact pressure applied at the conductive contact portion 165D. Further, a force component for causing a slide in a plane direction is also suppressed greatly between the conductive contact portion 165D and the board-side terminal 131.

Note that, in this embodiment, unlike the other embodiments, the pressure members 155A to 155C and the pressure springs 154A to 154C are not provided, and hence the internal structure of the connector housing 150D is simplified.

In the state of FIG. 20, however, when the elastic forces of the upper and lower contact terminals 160D fluctuate, torque for pivoting the wide portion 118 is applied, and hence the strength needs to be enhanced so that the resin molded portion is not broken at the end surface of the circuit board 130.

However, the dimension of the wide portion 118 in a vertical direction (direction of the thickness of the circuit board 130) is large, and hence, even when the upper and lower contact terminals 160D are arranged at the same positions in vertical alignment, the pressure bending portions 168D of the upper and lower contact terminals 160D do not interfere with each other. Accordingly, there is an advantage in that the board-side terminals 131 formed on the front and back of the circuit board 130 do not need to be arranged alternately in a staggered manner.

Further, it is important that the elastically deformable portion 162D of this embodiment has the U-shape. When the connector housing 150D is to be pushed from right to left in the state of FIG. 19, the elastically deformable portion 162D is not buckled due to the fact that the distal end portion of the contact terminal 160D is pushed back by the wide portion 118.

Therefore, the U-shaped outer surface of the elastically deformable portion 162D abuts against the inner surface of the tubular peripheral wall member 151 and the press-fitting and fixing portion 161D (specifically, the terminal holding portion 161*c*) of the contact terminal 160D, to thereby prevent clockwise pivoting about the mounting position.

However, the contact terminal 160D is easily pivoted counterclockwise about the mounting position. Thus, the conductive contact portion 165D abuts against the board-side terminal 131 at the position illustrated in FIG. 20.

(2) Summary and Feature of Fourth Embodiment

As is apparent from the above description, an electronic device unit 100D according to the fourth embodiment of the present invention includes the connector housing 150D provided to the plurality of board-side terminals 131 formed on at least one of both end surfaces of the circuit board 130. The connector housing 150D has connected at one end thereof the external connection conductor 140 being the wire harness or the wiring board, and includes at another end thereof the plurality of contact terminals 160D brought into electrical contact with the board-side terminals 131. The connector housing 150D is mounted on the circuit board 130 in a removable manner.

The contact terminal 160D includes: the press-fitting and fixing portion 161D received and held in the terminal holding portion 156D formed in the connector housing 150D and connected to the external connection conductor 140 in advance; the first member 163D coupled to the press-fitting and fixing portion 161D through intermediation of the elastically deformable portion 162D having the U-shaped structure; the second member 164D being coupled to the first member 163D through intermediation of the U-shaped folding portion and including the conductive contact portion 165D formed at the coupling portion; and the pressure bending portion 168D bent into the V-shape and coupled to the terminal end portion of the second member 164D through intermediation of the stamped reinforcement portion 167D.

Further, the circuit board 130 is molded integrally with the outer resin member 110 being an outer container. The board-side terminals 131 are exposed from the outer resin member 110. The circuit board 130 includes the end surface covering resin 112D formed at the distal end portion of the board end portion, on which the board-side terminals 131 are formed, and communicated to the outer resin member 110.

The connector housing 150D is mounted with the mounting reference point, which is arranged on the outer resin member 110, as the reference position.

The end surface covering resin 112D is molded integrally with the outer resin member 110 so that the position of the outer side surface of the end surface covering resin 112D is arranged at the predetermined reference dimension L0 from the mounting reference point of the connector housing 150D. The end surface covering resin 112D is configured to push back, when the connector housing 150D is mounted on the circuit board 130 through intermediation of the outer resin member 110, after elapse of the predetermined dead travel period, the pressure bending portion 168D of the contact terminal 160D so that the conductive contact portion 165D is brought into pressure contact with the board-side terminal 131.

As described above, in the electronic device unit 100D according to the present invention, the plurality of board-side terminals 131 are formed at the end portion of the circuit board 130, which is exposed from the outer resin member 110, and the connector housing 150D, which accommodates the contact terminals 160D electrically connected to the board-side terminals 131, is mounted on the electronic device unit 100D in a removable manner. Each of the contact terminals 160D includes the first member 163D coupled to the press-fitting and fixing portion 161D through intermediation of the elastically deformable portion 162D, and the second member 164D being coupled to the first member 163D through intermediation of the folding portion and including the pressure bending portion 168D formed at the terminal end of the second member 164D. The end surface covering resin 112D formed on the circuit board 130 pushes back the pressure bending portion 168D so that the conductive contact portion 165D formed at the folding portion of the first member 163D is pressed against the board-side terminal 131.

In particular, according to the fourth embodiment, the dimension of the wide portion 118 formed on the end surface covering resin 112D in a vertical direction (direction of the thickness of the circuit board 130) is large, and hence, even when the upper and lower contact terminals 160D are arranged at the same positions in vertical alignment, the pressure bending portions 168D of the upper and lower contact terminals 160D do not interfere with each other. Accordingly, there is a feature in that the board-side terminals 131 formed on the front and back of the circuit board 130 do not need to be arranged alternately in a staggered manner, and the internal structure of the connector housing 150D can be simplified.

The connector housing 150D includes the tubular peripheral wall member 151 and the bottom wall member 152.

The tubular peripheral wall member 151 includes the elastic hook member 157 engageable with the retaining projection 117 corresponding to the mounting reference point on the outer resin member 110.

The bottom wall member 152 has the through-hole through which the connection lead terminal to be connected to the external connection conductor 140 being the wire harness is drawn out, or the through-hole through which the connection lead terminal to be connected to the external connection conductor 140 being the wiring board is drawn out.

The bottom wall member 152 further has the terminal holding portion 156D to which the press-fitting and fixing portion 161D of the contact terminal 160D is press-fitted and fixed.

The end surface covering resin 112D includes the wide portion 118 extending in the direction of the thickness of the circuit board 130.

The circular-arc pressure contact surface 169D to be pushed back by the wide portion 118 is formed at the distal end position of the pressure bending portion 168D, which is bent into the V-shape from the second member 164D of the contact terminal 160D.

When the connector housing 150D is mounted on the circuit board 130 through intermediation of the outer resin member 110, after elapse of the predetermined dead travel period, the wide portion 118 of the end surface covering resin 112D abuts against the pressure contact surface 169D to push back the pressure contact surface 169D so that the conductive contact portion 165D is brought into pressure contact with the board-side terminal 131.

As described above, according to claim 6 of the present invention, when the connector housing is mounted, the pressure bending portion of the contact terminal is pushed back through intermediation of the end surface covering resin on the circuit board side so that the conductive contact portion of the contact terminal is brought into pressure contact with the board-side terminal.

Thus, the conductive contact portion is brought into pressure contact with the board-side terminal substantially in the right-angle direction so that no slide or slip occurs. Accordingly, there is a feature in that a predetermined pressure regulated by the elasticity of the entire contact terminal is obtained as the pressure for the pressure contact.

Further, when the connector housing is moved back and forth due to vibrations during actual operation of the electronic device unit, the pressing force is not applied from the connector housing side to the pressure bending portion. Accordingly, there is a feature in that the sliding friction between the conductive contact portion and the board-side terminal can be suppressed.

In the above description, the external connection conductor 140 is a wire harness. When the external connection conductor 140 is a wiring board, and an extension lead portion is integrated with each of the press-fitting and fixing portions 161A to 161D of the contact terminals 160A to 160D and is fit-inserted to a plated through-hole formed in the wiring board so as to carryout connection by soldering, it is suitable that each of the contact terminals 160A to 160D be inserted from left to right of FIGS. 4, 8, 12, and 18.

In the case of FIGS. 12 and 18, however, a window hole for allowing each of the pressure bending portions 168C and 168D to pass therethrough may be formed in the bottom wall member 152 of each of the connector housings 150C and 150D so that each of the contact terminals 160C and 160D is inserted from right to left of FIGS. 12 and 18.

What is claimed is:

1. An electronic device unit, comprising a connector housing provided to a plurality of board-side terminals formed on at least one of both end surfaces of a circuit board, the connector housing having one end thereof to which an external connection conductor being a wire harness or a wiring board is connected, and including at another end thereof a plurality of contact terminals brought into electrical contact with the board-side terminals, the connector housing being mounted on the circuit board in a removable manner, the contact terminal comprising:

a press-fitting and fixing portion received and held in a terminal holding portion formed in the connector housing and connected to the external connection conductor in advance or later;

a first member coupled to the press-fitting and fixing portion through intermediation of an elastically deformable portion having a U-shaped structure, a V-shaped structure, or a W-shaped structure;

a second member being coupled to the first member through intermediation of a U-shaped folding portion or a V-shaped folding portion and including a conductive contact portion formed at the coupling portion; and a pressure bending portion bent into an L-shape or a V-shape and coupled to a terminal end portion of the second member through intermediation of a stamped reinforcement portion, the circuit board being received in, fixed to, or molded integrally with an outer resin member being an outer container or a mounting bracket, the plurality of board-side terminals being exposed from the outer resin member, an end surface covering resin being formed at a distal end portion of a board end portion, on which the board-side terminals are formed, and being communicated to the outer resin member, the connector housing being mounted with a mounting reference point, which is arranged on the outer resin member, as a reference position, the end surface covering resin being molded integrally with the outer resin member so that a position of an outer side surface of the end surface covering resin is arranged at a predetermined reference dimension from the mounting reference point of the connector housing, the end surface covering resin being configured to push back the pressure bending portion of the contact terminal so that the conductive contact portion is brought into pressure contact with the board-side terminal, after elapse of a predetermined dead travel period, when the connector housing is mounted on the circuit board through intermediation of the outer resin member.

2. An electronic device unit according to claim 1, wherein the connector housing comprises a tubular peripheral wall member and a bottom wall member, wherein the tubular peripheral wall member comprises an elastic hook member engageable with a retaining projection corresponding to the mounting reference point on the outer resin member, wherein the bottom wall member has a through-hole through which a connection lead terminal to be connected to the external connection conductor being the wire harness is drawn out, or a through-hole through which a connection lead terminal to be connected to the external connection conductor being the wiring board is drawn out, wherein the bottom wall member further has the terminal holding portion to which the press-fitting and fixing portion of the contact terminal is press-fitted and fixed, and a center recess portion or a columnar projection portion in which a pressure member biased by a pressure spring in a push-out relationship is received, wherein a circular-arc pressure contact surface to be pushed back by the end surface covering resin is formed at a distal end position of the pressure bending portion, which is bent into the L-shape at a substantially right angle from the second member of the contact terminal, wherein a circular-arc end surface of the pressure member abuts against a pressure surface between the stamped reinforcement portion and the pressure contact surface of the contact terminal, and wherein, when the connector housing is mounted on the circuit board through intermediation of the outer resin member, after elapse of the predetermined dead travel period, the end surface covering resin pushes back the pressure contact surface of the contact terminal to pivot the second member with the circular-arc end surface of the pressure member as a fulcrum so that the conductive contact portion is brought into pressure contact with the board-side terminal.

3. An electronic device unit according to claim 2, wherein the elastically deformable portion holds the entire contact terminal at a released initial position, to thereby avoid contact between the conductive contact portion and the board-side terminal within the predetermined dead travel period of the connector housing, which is taken until the pressure bending portion is pushed back by the end surface covering resin, and wherein, under a state in which the conductive contact portion and the board-side terminal are brought into pressure contact with each other by the pressure spring, a relationship among a contact pressure P0 to be diminished by the elastically deformable portion, a contact pressure P1 to be applied by the pressure spring, and an effective contact pressure P1−P0 is P1−P0>P0.

4. An electronic device unit according to claim 1, wherein the connector housing comprises a tubular peripheral wall member and a bottom wall member, wherein the tubular peripheral wall member comprises an elastic hook member engageable with a retaining projection corresponding to the mounting reference point on the outer resin member, wherein the bottom wall member has a through-hole through which a connection lead terminal to be connected to the external connection conductor being the wire harness is drawn out, or a through-hole through which a connection lead terminal to be connected to the external connection conductor being the wiring board is drawn out, wherein the bottom wall member further has the terminal holding portion to which the press-fitting and fixing portion of the contact terminal is press-fitted and fixed, and a columnar projection portion or a center recess portion in which a pressure member biased by a pressure spring in a push-out relationship is inserted, wherein a distal end of the pressure bending portion, which is bent into the V-shape from the second member of the contact terminal, corresponds to a first abutment position where the pressure bending portion is pushed back by the end surface covering resin, wherein the pressure member has a trapezoidal shape in cross section, and a base of the trapezoid corresponds to a second abutment position where the pressure bending portion is pressed, and wherein, when the connector housing is mounted on the circuit board through intermediation of the outer resin member, after elapse of the predetermined dead travel period, the end surface covering resin pushes back the first abutment position of the pressure bending portion to pivot the second member with the second abutment position of the pressure member as a fulcrum so that the conductive contact portion is brought into pressure contact with the board-side terminal.

5. An electronic device unit according to claim 4, wherein the elastically deformable portion holds the entire contact terminal at a released initial position, to thereby avoid contact between the conductive contact portion and the board-side terminal within the predetermined dead travel period of the connector housing, which is taken until the pressure bending portion is pushed back by the end surface covering resin, and wherein, under a state in which the conductive contact portion and the board-side terminal are brought into pressure contact with each other by the pressure spring, a relationship among a contact pressure P0 to be diminished by the elastically deformable portion, a contact pressure P1 to be applied by the pressure spring, and an effective contact pressure P1−P0 is P1−P0>P0.

6. An electronic device unit according to claim 1, wherein the connector housing comprises a tubular peripheral wall member and a bottom wall member, wherein the tubular peripheral wall member comprises an elastic hook member engageable with a retaining projection corresponding to the mounting reference point on the outer resin member, wherein the bottom wall member has a through-hole through which a connection lead terminal to be connected to the external connection conductor being the wire harness is drawn out, or a through-hole through which a connection lead terminal to be connected to the external connection conductor being the wiring board is drawn out, wherein the bottom wall member further has the terminal holding portion to which the press-fitting and fixing portion of the contact terminal is press-fitted and fixed, and a columnar projection portion or a center recess portion in which a pressure member biased by a pressure spring in a push-out relationship is inserted, wherein a circular-arc pressure contact surface to be pushed back by a back surface of the pressure member is formed at a distal end position of the pressure bending portion, which is bent into the V-shape from the second member of the contact terminal, and wherein, when the connector housing is mounted on the circuit board through intermediation of the outer resin member, after elapse of the predetermined dead travel period, the end surface covering resin and a front surface of the pressure member abut against each other and the back surface of the pressure member pushes back the pressure contact surface so that the conductive contact portion is brought into pressure contact with the board-side terminal.

7. An electronic device unit according to claim 6, wherein the elastically deformable portion holds the entire contact terminal at a released initial position, to thereby avoid contact between the conductive contact portion and the board-side terminal within the predetermined dead travel period of the connector housing, which is taken until the pressure bending portion is pushed back by the end surface covering resin, wherein an outer peripheral surface of the elastically deformable portion abuts against the press-fitting and fixing portion and an inner wall surface of the tubular peripheral wall member, wherein, when the pressure bending portion is pushed back by the end surface covering resin, the elastically deformable portion is easily curved so that the first member and the second member are pivoted forward, whereas the elastically deformable portion is prevented from being compressed and deformed in a retreated manner, and wherein, under a state in which the conductive contact portion and the board-side terminal are brought into pressure contact with each other, a relationship among a contact pressure P0 to be diminished by the elastically deformable portion, a contact pressure P1 to be limited by elasticity of the contact terminal, and an effective contact pressure P1−P0 is P1−P0>P0.

8. An electronic device unit according to claim 1, wherein the connector housing comprises a tubular peripheral wall member and a bottom wall member, wherein the tubular peripheral wall member comprises an elastic hook member engageable with a retaining projection corresponding to the mounting reference point on the outer resin member, wherein the bottom wall member has a through-hole through which a connection lead terminal to be connected to the external connection conductor being the wire harness is drawn out, or a through-hole through which a connection lead terminal to be connected to the external connection conductor being the wiring board is drawn out, wherein the bottom wall member further has the terminal holding portion to which the press-fitting and fixing portion of the contact terminal is press-fitted and fixed, wherein the end surface covering resin comprises a wide portion extending in a direction of a thickness of the circuit board, wherein a circular-arc pressure contact surface to be pushed back by the wide portion is formed at a distal end position of the pressure bending portion, which is bent into the V-shape from the second member of the contact terminal, and wherein, when the connector housing is mounted on the circuit board through intermediation of the outer resin member, after elapse of the predetermined dead travel period, the wide portion of the end surface covering resin abuts against the pressure contact surface to push back the pressure contact surface so that the conductive contact portion is brought into pressure contact with the board-side terminal.

9. An electronic device unit according to claim 8, wherein the elastically deformable portion holds the entire contact terminal at a released initial position, to thereby avoid contact between the conductive contact portion and the board-side terminal within the predetermined dead travel period of the connector housing, which is taken until the pressure bending portion is pushed back by the end surface covering resin, wherein an outer peripheral surface of the elastically deformable portion abuts against the press-fitting and fixing portion and an inner wall surface of the tubular peripheral wall member, wherein, when the pressure bending portion is pushed back by the end surface covering resin, the elastically deformable portion is easily curved so that the first member and the second member are pivoted forward, whereas the elastically deformable portion is prevented from being compressed and deformed in a retreated manner, and wherein, under a state in which the conductive contact portion and the board-side terminal are brought into pressure contact with each other, a relationship among a contact pressure P0 to be diminished by the elastically deformable portion, a contact pressure P1 to be limited by elasticity of the contact terminal, and an effective contact pressure P1−P0 is P1−P0>P0.

10. An electronic device unit according to claim 1, wherein the end surface covering resin is communicated to the outer resin member by at least one of a side surface covering resin formed at a side surface end portion of the circuit board and a plurality of terminal separating resins formed between the plurality of board-side terminals.

11. An electronic device unit according to claim 1, wherein the board-side terminal is formed by coating a surface of a copper foil pattern coated by an oxidation-resistant material, the oxidation-resistant material being gold or the oxidation-resistant material being gold as a main component, and wherein the contact terminal is a copper alloy, as typified by brass excellent in conductivity and spring property, caoted by an oxidation-resistant material after a bending process, the oxidation-resistant material being gold or the oxidation-resistant material being gold as a main component.

12. An electronic device unit according to claim 1, wherein the contact terminal further comprises a reinforcement rib formed by bending a side surface of the contact terminal or a reinforcement rib formed by stamping a center of the contact terminal into a circular-arc shape, wherein the conductive contact portion has a stamped circular-arc surface formed at a folding and coupling portion between the first member and the second member, and wherein an elastic strength of the contact terminal is adjusted based on a length of the reinforcement rib at a part positioned in the second member and a bending height of the rib or a stamping depth of the rib.

* * * * *